US009289032B2

(12) United States Patent
Auger et al.

(10) Patent No.: US 9,289,032 B2
(45) **Date of Patent: *Mar. 22, 2016**

(54) SOLE STRUCTURE WITH EXTENDABLE CLEAT

(75) Inventors: Perry W. Auger, Tigard, OR (US); Andrew Caine, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 976 days.

This patent is subject to a terminal disclaimer.

(21) Appl. No.: 13/204,010

(22) Filed: Aug. 5, 2011

(65) Prior Publication Data

US 2013/0031810 A1 Feb. 7, 2013
US 2015/0366296 A9 Dec. 24, 2015

Related U.S. Application Data

(63) Continuation-in-part of application No. 12/752,318, filed on Apr. 1, 2010, now Pat. No. 8,453,349.

(51) Int. Cl.
*A43C 15/14* (2006.01)
*A43C 15/16* (2006.01)

(52) U.S. Cl.
CPC ..... *A43C 15/14* (2013.01); *A43C 15/168* (2013.01)

(58) Field of Classification Search
CPC ..... A43C 13/04; A43C 15/005; A43C 15/16; A43C 15/161; A43C 15/165; A43C 15/167; A43B 13/26; A43B 5/02
See application file for complete search history.

(56) References Cited

U.S. PATENT DOCUMENTS

| | | | | | |
|---|---|---|---|---|---|
| 303,287 | A | | 8/1884 | Hunn | |
| 2,053,906 | A | * | 9/1936 | Fuller | 36/59 R |
| 2,095,095 | A | * | 10/1937 | Howard | 36/59 R |
| 2,207,476 | A | * | 7/1940 | Bernstein | 36/59 R |
| 2,258,734 | A | * | 10/1941 | Brady | 36/59 R |
| 2,491,596 | A | * | 12/1949 | Zaleski et al. | 36/59 R |
| 2,689,417 | A | * | 9/1954 | Bernstein | 36/59 R |
| 3,354,561 | A | * | 11/1967 | Cameron | 36/134 |
| 4,375,729 | A | | 3/1983 | Buchanen, III | |
| 5,873,184 | A | | 2/1999 | Ihlenburg | |
| 5,938,384 | A | * | 8/1999 | Pratt | 411/55 |
| 5,957,642 | A | * | 9/1999 | Pratt | 411/55 |

(Continued)

FOREIGN PATENT DOCUMENTS

| | | |
|---|---|---|
| GB | 2420485 | 5/2006 |
| JP | 2006025990 | 2/2006 |

(Continued)

OTHER PUBLICATIONS

International Preliminary Report on Patentability mailed Feb. 20, 2014 in PCT/US2012/048958.

(Continued)

*Primary Examiner* — Khoa Huynh
*Assistant Examiner* — Megan Brandon
(74) *Attorney, Agent, or Firm* — Plumsea Law Group, LLC

(57) ABSTRACT

A sole structure including a cleat assembly is disclosed. The cleat assembly includes a covering member, an actuating assembly and a cleat sub-assembly. The cleat sub-assembly includes a cleat member that can extend in length under a force applied by a foot. The actuating assembly directs force applied by a foot at the covering member to the cleat member so that the cleat can extend and penetrate further into a ground surface. The actuating assembly can include a pivot plate that pivots about an angled portion of the cleat sub-assembly.

31 Claims, 15 Drawing Sheets

(56) References Cited

U.S. PATENT DOCUMENTS

| | | | | |
|---|---|---|---|---|
| 6,256,907 | B1 | 7/2001 | Jordan et al. | |
| 6,449,880 | B1 | 9/2002 | Calabrese et al. | |
| 7,194,826 | B2 | 3/2007 | Ungari | |
| 7,254,909 | B2 | 8/2007 | Ungari | |
| 7,412,784 | B1 * | 8/2008 | Bobbett | 36/67 R |
| 7,721,469 | B2 | 5/2010 | Holbert | |
| 8,079,160 | B2 * | 12/2011 | Baucom et al. | 36/61 |
| 8,104,193 | B1 * | 1/2012 | Teteriatnikov | 36/8.2 |
| 2004/0107606 | A1 * | 6/2004 | De Paoli | 36/134 |
| 2004/0159020 | A1 * | 8/2004 | Briant et al. | 36/134 |
| 2004/0187356 | A1 * | 9/2004 | Patton | 36/134 |
| 2005/0160629 | A1 * | 7/2005 | Jungkind | 36/127 |
| 2005/0172518 | A1 * | 8/2005 | Ungari | 36/134 |
| 2005/0257403 | A1 * | 11/2005 | De Paoli | 36/67 D |
| 2006/0016101 | A1 | 1/2006 | Ungari | |
| 2006/0064905 | A1 * | 3/2006 | Hudson et al. | 36/128 |
| 2007/0251128 | A1 * | 11/2007 | Yen | 36/134 |
| 2008/0163438 | A1 * | 7/2008 | Briant et al. | 12/146 B |
| 2008/0196274 | A1 * | 8/2008 | Gerber | 36/100 |
| 2008/0263904 | A1 * | 10/2008 | Scholz | 36/134 |
| 2009/0185853 | A1 * | 7/2009 | Koelling et al. | 403/229 |
| 2009/0272011 | A1 * | 11/2009 | Drollinger et al. | 36/127 |
| 2010/0083541 | A1 * | 4/2010 | Baucom et al. | 36/25 R |
| 2010/0229427 | A1 * | 9/2010 | Campbell et al. | 36/134 |
| 2010/0251578 | A1 * | 10/2010 | Auger et al. | 36/67 A |
| 2011/0005103 | A1 | 1/2011 | Krouse | |
| 2011/0023329 | A1 * | 2/2011 | Auger et al. | 36/134 |
| 2011/0088287 | A1 * | 4/2011 | Auger et al. | 36/107 |
| 2011/0197478 | A1 * | 8/2011 | Baker | 36/59 R |
| 2012/0192458 | A1 * | 8/2012 | Auger et al. | 36/134 |
| 2012/0198726 | A1 * | 8/2012 | O'Brien et al. | 36/136 |
| 2012/0210545 | A1 * | 8/2012 | Koelling et al. | 24/595.1 |
| 2012/0210608 | A1 * | 8/2012 | Baker et al. | 36/134 |

FOREIGN PATENT DOCUMENTS

| | | |
|---|---|---|
| WO | 03071893 | 9/2003 |
| WO | 2009110822 | 9/2009 |

OTHER PUBLICATIONS

International Search Report dated Dec. 13, 2012 in International Patent Application No. PCT/US2012/048958.

* cited by examiner

SOLE STRUCTURE WITH EXTENDABLE CLEAT

This application is a continuation in part of U.S. Pat. No. 8,453,349, the entirety of which is incorporated by reference.

BACKGROUND

The present embodiments relate generally to articles of footwear, and in particular to articles of footwear with extendable cleats.

Articles of footwear generally include an upper and a sole. The sole can further include a midsole and/or outsole. The upper helps to keep the sole fastened to the foot and generally provides protection for the foot. The sole can provide various kinds of support, cushioning and shock absorption.

SUMMARY

In one aspect, a sole structure for article of footwear including a cleat assembly includes a cleat member with an extending portion, where the extending portion has a first end fixed relative to the sole structure. The cleat assembly also includes an actuating assembly with a pivot plate and an actuating member. The pivot plate has a first end portion and a second end portion and the actuating member is attached to the first end portion. The actuating member disposed within the extending portion and positioned to transfer force from a foot of the wearer to a second end of the extending portion. The pivot plate assembly is configured to pivot about the second end portion of the pivot plate.

In another aspect, a sole structure for an article of footwear with a cleat assembly includes a cleat sub-assembly comprising a base portion and a cleat member attached to the base portion. The base portion includes an angled portion. The cleat member includes an extending portion, where the extending portion has a first end attached to the base portion. The cleat assembly also includes an actuating assembly with a pivot plate and an actuating member attached to the pivot plate. The actuating member is disposed within the extending portion and positioned to transfer force from a foot of the wearer to a second end of the extending portion. The angled portion comprises a fulcrum for the pivot plate.

In another aspect, a sole structure for an article of footwear with a cleat assembly includes an actuating assembly with a pivot plate and an actuating member, where the pivot plate has a first end portion and a second end portion and where the actuating member is disposed adjacent to the first end portion. The cleat assembly also includes a covering member with a first region and a second region, where the first region is disposed adjacent to the first end portion of the pivot plate and the second region is disposed adjacent to the second end portion of the pivot plate. The cleat assembly further includes a cleat sub-assembly with a base portion and a cleat member. The base portion includes a hole for receiving the cleat member and an angled portion that is configured to contact the second end portion of the pivot plate. The cleat member is configured to receive the actuating member and the cleat member can be extended away from the sole structure by the actuating member. The cleat assembly is configured to transfer force from the first region of the covering member to the actuating member and the cleat assembly is configured to transfer force from the second region of the covering member to the actuating member.

In another aspect, a sole structure for an article of footwear includes a first cleat assembly and a second cleat assembly. The first cleat assembly includes a first actuating assembly and a first cleat member. The second cleat assembly includes a second actuating assembly and a second cleat member. The cleat assembly is further associated with a first axis that is associated with a first length of the first cleat assembly and a second axis that is associated with a second length of the second cleat assembly. The first cleat assembly and the second cleat assembly are arranged on the sole structure so that the first axis is angled with respect to the second axis.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
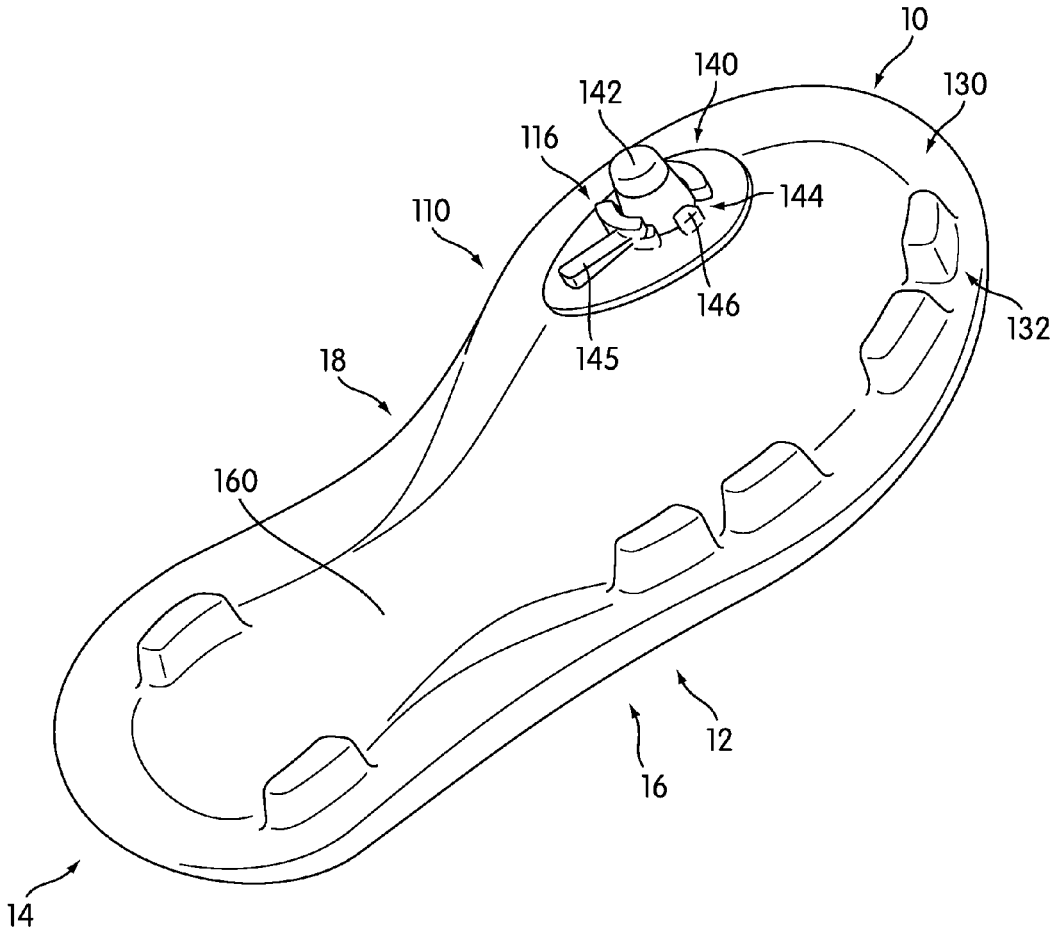
FIG. 1 is an isometric view of a bottom surface of an embodiment of a sole structure including a cleat assembly.

FIG. 1 illustrates a bottom isometric view of an embodiment of sole structure 110 configured for use with an article of footwear. For clarity, the following detailed description discusses an exemplary embodiment, in the form of a sole structure for a sports shoe, but it should be noted that the present embodiments could take the form of a sole structure for any article of footwear including, but not limited to: hiking boots, soccer shoes, football shoes, sneakers, rugby shoes, basketball shoes, baseball shoes as well as other kinds of shoes.

For purposes of reference, components of sole structure 110 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, sole structure 110 may include lateral side 16 and medial side 18. In particular, lateral side 16 and medial side 18 may be opposing sides of sole structure 110. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of sole structure 110. Likewise, lateral side 16 and medial side 18 are intended to represent generally two sides of a sole structure, rather than precisely demarcating sole structure 110 into two halves. In addition, forefoot portion 10, midfoot portion 12 and heel portion 14, as well as lateral side 16 and medial side 18, can also be applied to individual components of a sole structure, such as a sockliner, insole or any other component.

For consistency and convenience, directional adjectives are employed throughout this detailed description corresponding to the illustrated embodiments. The term "longitudinal" as used throughout this detailed description and in the claims refers to a direction extending a length of a component. In some cases, the longitudinal direction may extend from a forefoot portion to a heel portion of the sole structure. Also, the term "lateral" as used throughout this detailed description and in the claims refers to a direction extending a width of the sole structure. In other words, the lateral direction may extend between a medial side and a lateral side of the sole structure. Furthermore, the term "vertical" as used throughout this detailed description and in the claims refers to a direction generally perpendicular to a lateral and longitudinal direction. For example, in cases where a sole structure is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article and/or a sole structure.

In some embodiments, sole structure 110 may be joined with an upper. The upper could be configured with any design, shape, size and/or color. In other cases, however, sole structure 110 may not be attached to an upper.

In some embodiments, sole structure 110 may be configured to provide traction for an article of footwear. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

In different embodiments, sole structure 110 may include different components. For example, sole structure 110 may include an outsole, a midsole, and/or an insole. In some cases, one or more of these components may be optional. In some cases, sole structure 110 comprises a substantially rigid chassis that provides support and durability for an article. In one embodiment, sole structure 110 may comprise an outsole or lower layer for the sole of a shoe and could be incorporated with a separate midsole (not shown) and/or insole.

Sole structure 110 can include cleat system 130 that comprises one or more cleat members. The term "cleat" or "cleat member" as used throughout this detailed description and in the claims refers to a member or element that is configured to increase traction with a ground surface. A cleat member may be configured to penetrate into a ground surface in order to facilitate traction, stability and/or control for a user.

In some cases, cleat system 130 includes plurality of cleats 132 disposed on lower surface 160 of sole structure 110. Plurality of cleats 132 may comprise any type of cleats disposed in any portion of sole structure 110. For example, in some cases, plurality of cleats 132 includes four cleats disposed in forefoot portion 10 and two cleats disposed in heel portion 14 of sole structure 110. In other cases, however, any other number and/or arrangement of cleats is possible. Moreover, in different embodiments the shape and/or size of cleats could vary.

In some cases, plurality of cleats 132 comprises cleats with an approximately ridge-like shape. However, in other embodiments, any other shape for plurality of cleats 132 is possible. In some other embodiments, different cleats of plurality of cleats 132 could have substantially different shapes in order to provide different amounts of traction over different portions of sole structure 110.

Cleat system 130 can also include cleat assembly 140. Cleat assembly 140 comprises cleat member 142. In some cases, cleat member 142 is an extendable cleat that is configured to penetrate further into a ground surface following actuation of some kind. In contrast to plurality of cleats 132, which are fixed in place with respect to sole structure 110, cleat member 142 is capable of extending further outwardly from sole structure 110 in order to provide enhanced traction and control for a user. The operation of cleat assembly 140, including the extension of cleat member 142, is described in detail below.

In some cases, cleat assembly 140 can also include projections 144 that are part of cleat assembly 140. Projections 144 may be fixed in place with respect to sole structure 110 in order to provide stability for the actuation of cleat member 142. Primary projection 145 may be a wedge-like projection that extends outwardly from cleat member 142. Additionally, secondary projections 146 may partially encircle cleat member 142. In other embodiments, any other number and/or shape of projections could be used with cleat assembly 140.

Examples of articles of footwear with extendable traction elements are disclosed in Auger, U.S. Pat. No. 8,453,349, the entirety of which is hereby incorporated by reference.

In different embodiments, the approximate location of a cleat assembly with an extendable cleat member could be varied. For example, in some cases, one or more cleat assemblies could be disposed in forefoot portion 10 of sole structure 110. In other cases, one or more cleat assemblies could be disposed in midfoot portion 12 and/or heel portion 14 of sole structure 110. For purposes of illustration, sole structure 110 is shown with a single cleat assembly 140 disposed in region 116 of sole structure 110. In some cases, region 116 may correspond to the approximate location of the ball of the foot. In other cases, region 116 may correspond to the approximate location of the big toe of the foot. In still other cases, region 116 could correspond to a region located between the ball of the foot and the big toe of the foot. Moreover, in other embodiments, region 116 could be associated with any other portion of sole structure 110. The location of a cleat assembly with an extendable cleat may be selected to correspond to a region where downward force is applied by a foot during various kinds of motion such as running and/or cutting.

Although a single cleat assembly is shown in the current embodiment, other embodiments could include additional cleat assemblies at various different locations on sole structure 110. For example, in another embodiment, a first cleat assembly could be disposed on a region of the sole structure corresponding to the ball of the foot and a second cleat assembly could be disposed on a region of the sole structure corresponding to the big toe of the foot.

Figure 2:
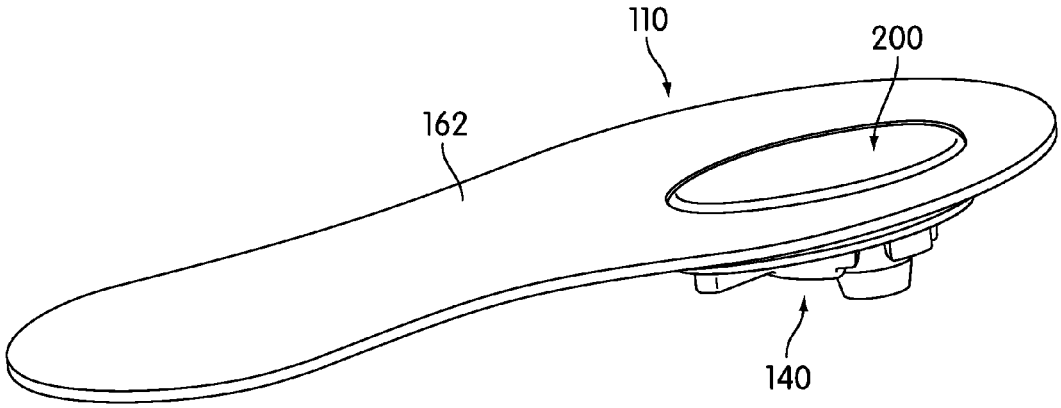
FIG. 2 is an isometric view of a top surface of an embodiment of a sole structure including a cleat assembly.
Figure 3:
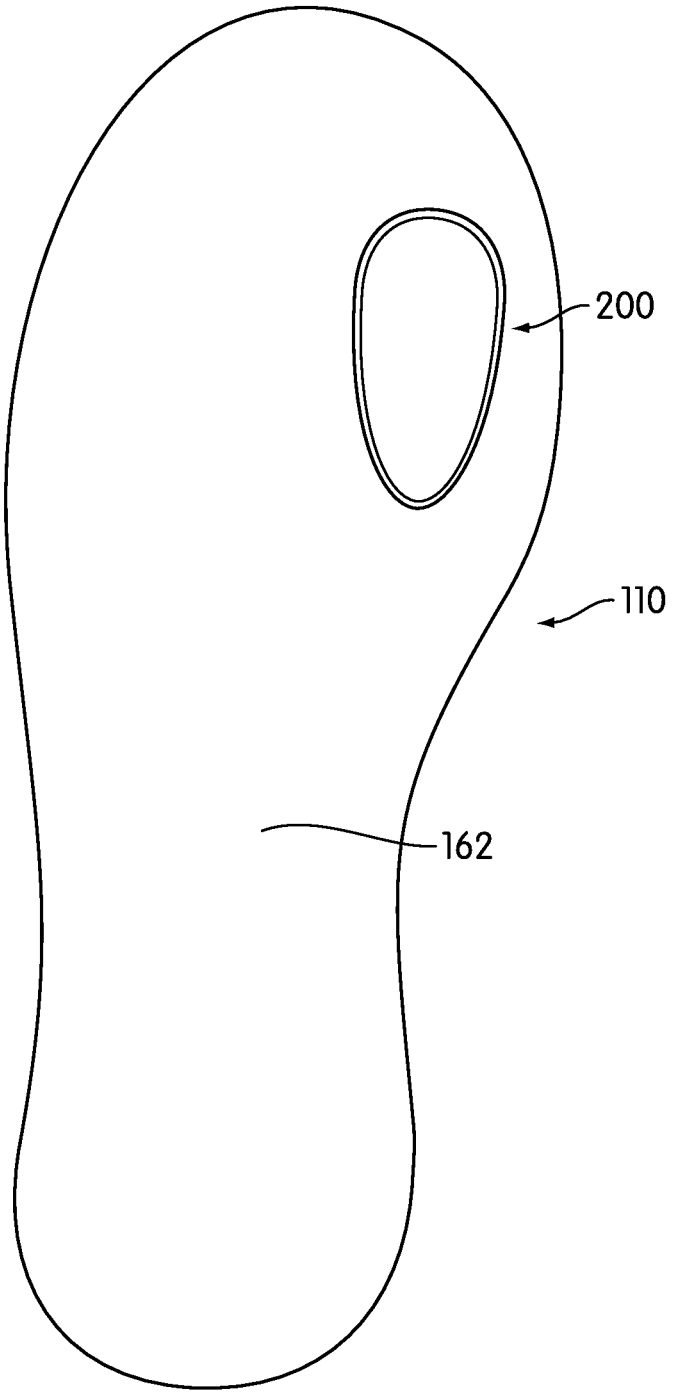
FIG. 3 is a top down view of an embodiment of a sole structure.

FIGS. 2 and 3 illustrate an isometric view and top down view, respectively, of an upper surface 162 of sole structure 110. Upper surface 162 is a surface that is configured to face inwardly when sole structure 110 is attached to an upper. In particular, upper surface 162 is located proximally to lower surface 160 (see FIG. 1) and therefore may be adjacent to a foot when an article incorporating sole structure 110 is worn.

Referring to FIGS. 2 and 3, sole structure 110 can include actuating zone 200. Actuating zone 200 comprises a region of upper surface 162 where force can be applied to actuate cleat assembly 140. Generally, actuating zone 200 may be disposed over cleat assembly 140 so that a force applied to actuating zone 200 can be transferred directly to cleat assembly 140. In other cases, however, actuating zone 200 could be located on a different portion of sole structure 110 than cleat assembly 140.

Figure 4:
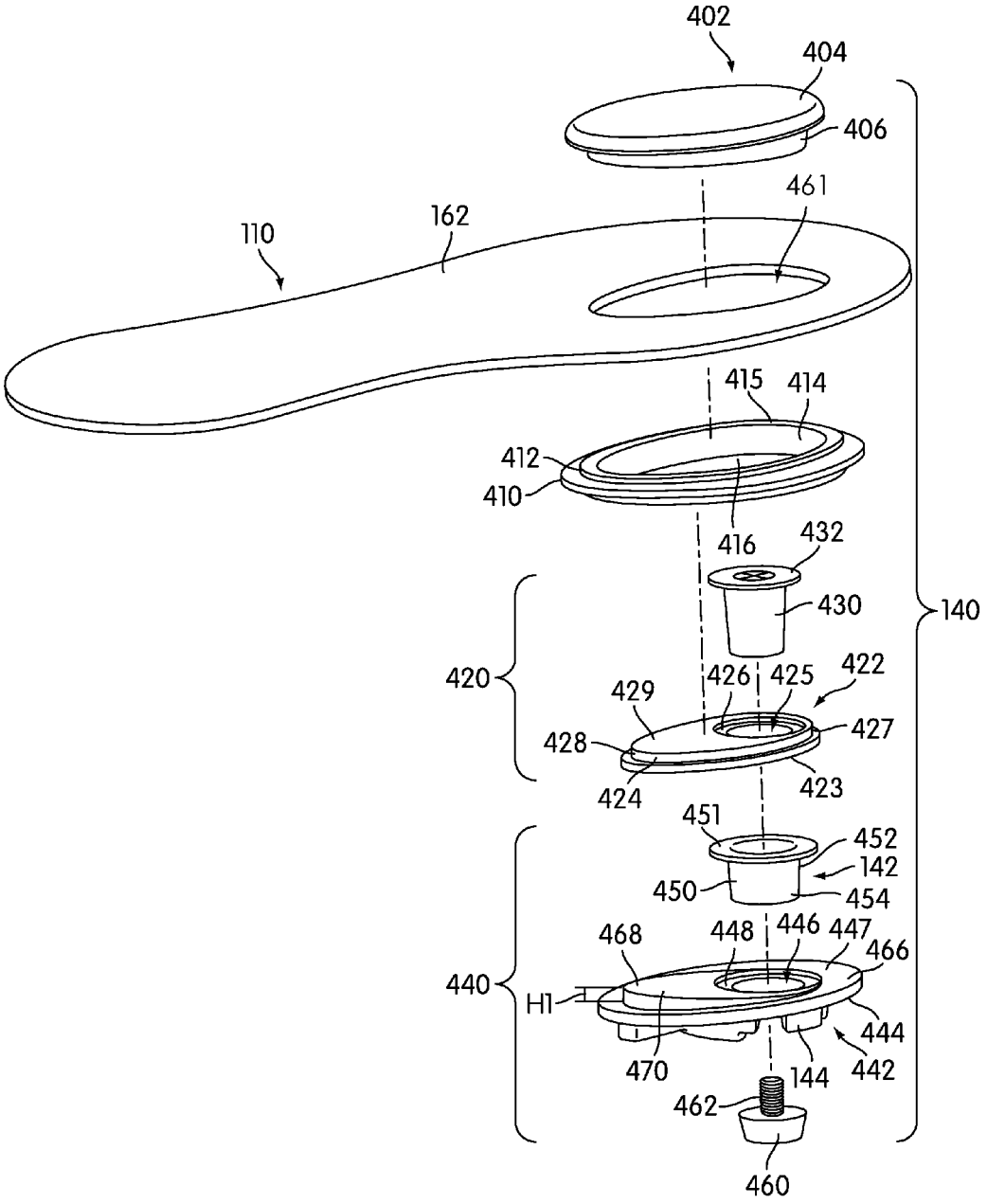
FIG. 4 is an exploded isometric view of a cleat assembly with a sole structure.

FIG. 4 illustrates an isometric exploded view of cleat assembly 140. Cleat assembly 140 may comprise covering member 402, housing 410, actuating assembly 420 and cleat sub-assembly 440. In some cases, housing 410 may be mounted directly to one or more portions of sole structure 110. For example, in the current embodiment, outer rim 412 of housing 410 may insert into gap 461 of sole structure 110. Interior rim 414 of housing 410 may further receive covering member 402 from above. In addition, housing 410 receives actuating assembly 420 and cleat sub-assembly 440, in order to secure actuating assembly 420 and cleat sub-assembly 440 to sole structure 110.

In some cases, interior rim 414 can taper from upper portion 415 to lower portion 416. In other words, the cross-sectional area of interior rim 414 may decrease from upper portion 415 to lower portion 416. In some embodiments, interior rim 414 can be sized so that components of actuating assembly 420 and/or cleat sub-assembly 440 may fit through upper portion 415 but not lower portion 416. This arrangement can help secure these components within housing 410. In other cases, however, interior rim 414 may not be tapered and could have a substantially constant cross-sectional area from upper portion 415 to lower portion 416.

Covering member 402 may extend through gap 461 of sole structure 110 and into housing 410. In some cases, covering member 402 includes first portion 404 that provides a substantially soft or elastic surface that may deform slightly under an applied force. In addition, covering member 404 may include second portion 406 that is configured to contact actuating assembly 420. With this arrangement, covering member 402 may provide a mechanism for transferring force between a wearer's foot and actuating assembly 420. In addition, covering member 402 acts to cover the various components of cleat assembly 140 in order to maintain a generally smooth upper surface 162 for sole structure 110.

Actuating assembly 420 can further include pivot plate 422 and actuating member 430. Pivot plate 422 may include a first portion 423 and a second portion 424 that is raised up from first portion 423. In some cases, the cross-sectional area of second portion 424 may be slightly less than the cross-sectional area of first portion 423. Second portion 424 may be configured to contact second portion 406 of covering member 402. In some cases, second portion 424 of pivot plate 422 and second portion 406 of covering member 402 can have substantially similar cross-sectional areas and/or cross-sectional shapes in order to help maximize the transfer of forces from covering member 402 to actuating assembly 420.

Pivot plate 422 also includes first end portion 427 and second end portion 428. First end portion 427 may include hole 425. In some cases, hole 425 is a substantially rounded hole that is configured to receive actuating member 430. Moreover, in some cases, hole 425 may be further associated with recessed portion 426 that receives flange 432 of actuating member 430. This allows actuating member 430 to attach to pivot plate 422 so that actuating member 430 is substantially flush with upper surface 429 of pivot plate 422.

In some cases, actuating member 430 can be fixedly secured to pivot plate 422. In other cases, however, actuating member 430 may not be secured to pivot plate 422 and may be configured to freely rotate within hole 425. This arrangement allows actuating member 430 to be fastened to a component of cleat sub-assembly 440, as discussed in detail below.

Cleat sub-assembly 440 can include base portion 442 as well as cleat member 142. Cleat member 142 includes extending portion 450 (also referred to as an elastic member) and tip portion 460. Extending portion 450 can include first end 452 and second end 454. In some cases, tip portion 460 is joined with second end 454.

Cleat sub-assembly 440 can include provisions for engaging with actuating member 430. In some cases, tip portion 460 includes fastening portion 462 that is configured to engage actuating member 430. In some cases, fastening portion 462 could be a threaded post. In other cases, however, fastening portion 462 could incorporate any other kind of fastening mechanism. In still other cases, tip portion 460 may not fasten to actuating member 430.

In some embodiments, extending portion 450 may be a substantially flexible portion that can extend and/or stretch under an applied force. In some cases, tip portion 460 may comprise a substantially rigid portion that is more rigid than extending portion 450. As extending portion 450 stretches or extends, so that first end 452 is displaced further from second end 454, tip portion 460 may also extend away from first end portion 452. In other cases, tip portion 460 could also be made of a substantially elastic material and may partially deform under an applied force.

Base portion 442 includes projections 144 on lower side 444 that have already been discussed and shown in FIG. 1. Projections 144 can help increase traction and provide additional balance while cleat member 142 is engaged with a ground surface. Base portion 442 may also include hole 446 on first end portion 466 that receives extending portion 450.

In some cases, hole 446 is further associated with recessed portion 448 that may receive flange 451 of extending portion 450.

Base portion 442 can also include ramp portion 470 on upper side 447 of base portion 442. Ramp portion 470 rises from hole 446 towards second end portion 468 of base portion 442. In different embodiments, the height H1 of ramp portion 470 can vary. In some cases, height H1 can have a value in the range between 0 and 3 millimeters. In other cases, height H1 can have a value in the range between 0 and 5 millimeters. In still other cases, height H1 can have a value that is greater than 5 millimeters. In some cases, the value of height H1 could be selected in order to obtain a desired amount of actuation for actuating assembly 420 under a predetermined force.

In some embodiments, the slope of ramp portion 470 can vary. In some cases, the slope may be substantially constant. In other cases, the slop may vary, so that ramp portion 470 is curved. In some cases, the geometry of ramp portion 470 (including the slope) could be selected to achieve a predetermined amount of actuation for actuating assembly 420 under a predetermined force.

In different embodiments, the geometry of various components of cleat assembly 140 could vary. In some cases, some components could be substantially rounded. In other cases, some components could be substantially oval-like in shape. Moreover, still other components could have any other shapes including, but not limited to: rounded, circular, oval, rectangular, triangular, polygonal, regular and/or irregular shapes. Components could have symmetric shapes or asymmetric shapes. In one embodiment, some components of cleat assembly 140 could have an anti-symmetric shape. In some cases, the anti-symmetric shape may be a tear-drop like shape. For example, the cross-sectional shapes of covering member 402, housing 410, pivot plate 422 and base portion 442 can have substantially tear-drop like shapes. Furthermore, cross-sectional area of each component is larger at the ends aligned with cleat member 142. This tear drop like shape allows cleat assembly 140 to have a larger cross-sectional area in the region directly over cleat member 142. This may result in a tear-drop like shape for the actuating zone 200 over which cleat assembly 140 can be engaged by a foot, as seen in FIG. 3. This arrangement may help control the regions of sole structure 110 where off axis actuation of cleat assembly 140 can occur.

Figure 5:
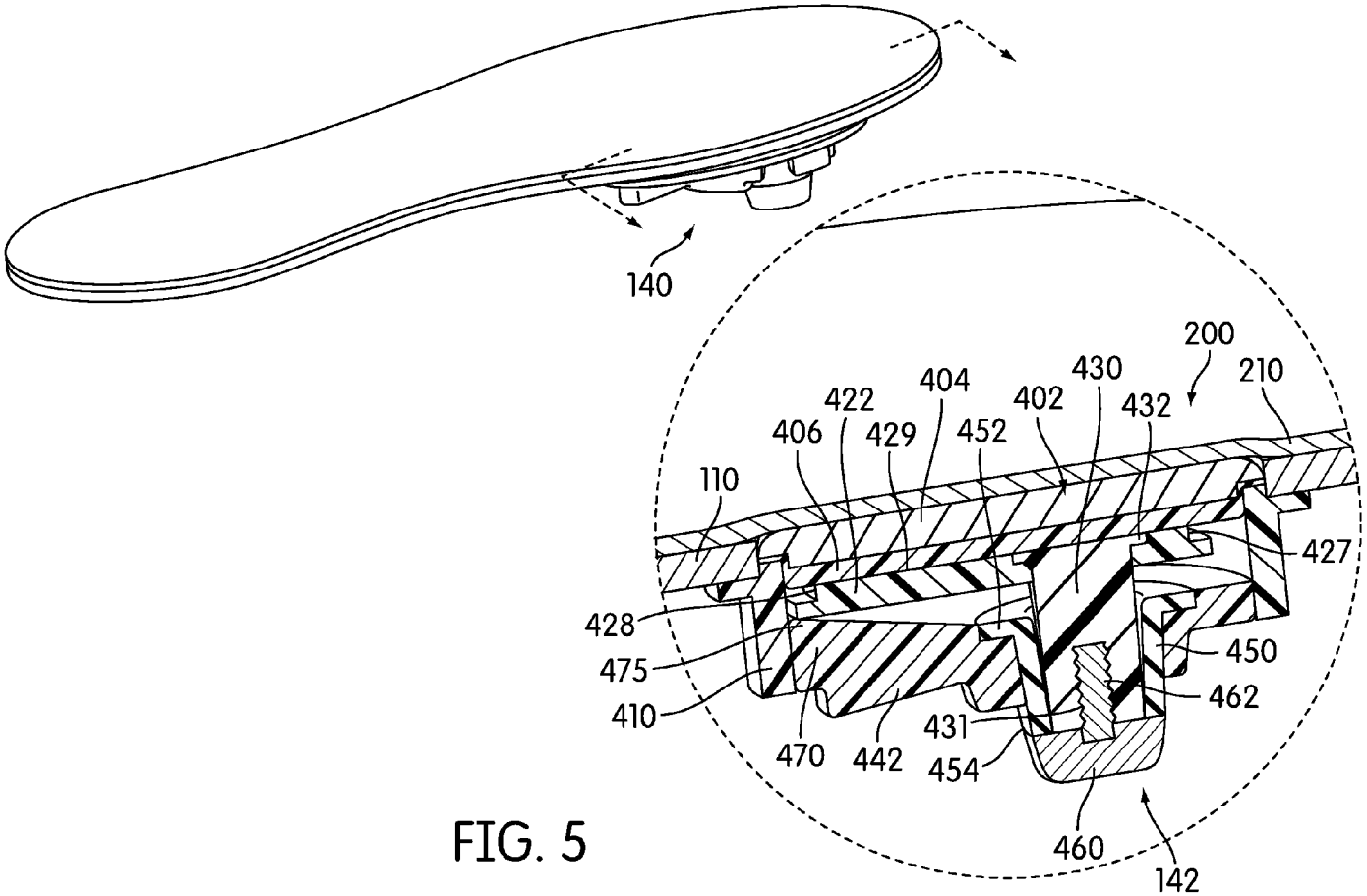
FIG. 5 is an exploded cut-away view of an embodiment of a cleat assembly.
Figure 6:
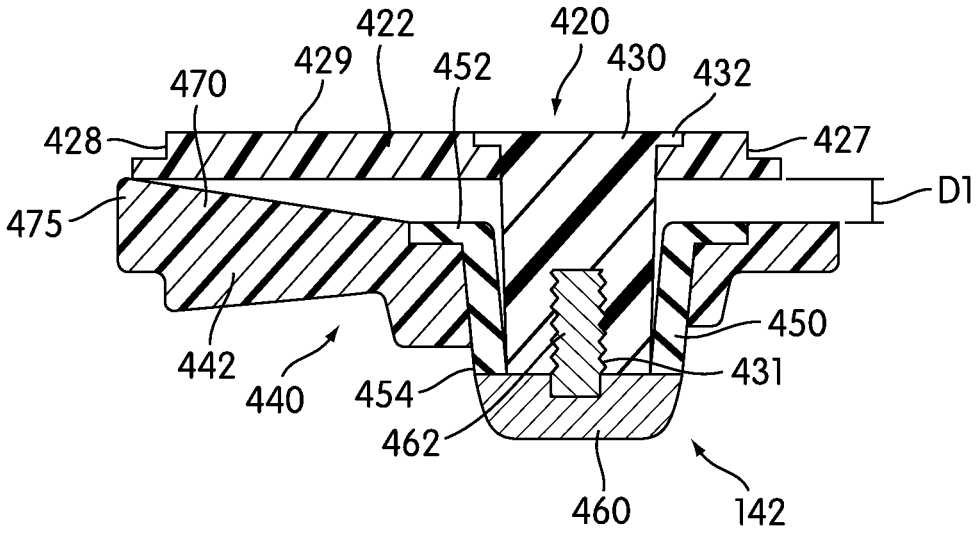
FIG. 6 is an isolated cross sectional view of an embodiment of an actuating assembly and a cleat sub-assembly.

FIG. 5 illustrates a cross sectional view of cleat assembly 140. FIG. 6 illustrates an isolated cross sectional view of the arrangement of actuating assembly 420 and cleat sub-assembly 440. As seen in FIG. 5, in some cases, cleat assembly 140 is covered by sock-liner 210. Sock-liner 210 is optional and may improve comfort for a user in some cases. Sock-liner 210 can help reduce chaffing, rubbing, or other discomfort resulting from contact between the wearer's foot and the sole structure. In other embodiments, however, sole structure 110 may not include a sock-liner.

Referring to FIGS. 5 and 6, actuating member 430 may be inserted through extending portion 450. In one embodiment, actuating member 430 may include threaded cavity 431 that engages fastening portion 462 in order to secure actuating member 430 to tip portion 460. This arrangement provides a connection between actuating member 430 and tip portion 460 so that cleat member 142 and actuating member 430 move together and helps keep actuating member 430 disposed inside extending portion 450.

Covering portion 402 is partially inserted into housing 410. In particular, first portion 404 is disposed directly beneath sock-liner 210. Second portion 406 is disposed within housing 410 and is disposed against pivot plate 422. This allows for covering portion 402 to transfer force to actuating assembly 430 as a force is applied to actuating zone 200 of sole structure 110. In some embodiments, it is possible for second portion 406 of covering member 402 to be permanently attached to pivot plate 422. In other embodiments, however, second portion 406 may not be attached to pivot plate 422.

A cleat assembly can include provisions for improving actuation when a force is applied away from a cleat member (also referred to as off axis actuation). For example, in some cases, a cleat assembly can include a pivoting mechanism that helps ensure a cleat member extends when a user applies a force away from a central axis of the cleat member.

Referring to FIGS. 5 and 6, ramp portion 470 may provide a fulcrum for pivot plate 422. In some cases, second end portion 428 of pivot plate 422 may contact raised end 475 of ramp portion 470. Furthermore, the normal elastic force provided by extending portion 450 keeps actuating member 430 in a position such that first end portion 427 of pivot plate 422 is raised above base portion 442. For example, in the current embodiment, first end portion 427 of pivot plate 422 is raised above base portion 442 by a distance D1 (see FIG. 6). With this arrangement, pivot plate 422 may pivot about second end portion 428 when a downward force is applied to pivot plate 422. In particular, first end portion 427 of pivot plate 422 is lowered under an applied force, while second end portion 428 remains in contact with raised end 475 of ramp portion 470. The actuation of cleat assembly 140 is described in further detail below.

Methods of making and assembling the various components of cleat assembly 140 can vary in different embodiments. As an example, actuating assembly 420 could be formed using a two shot molding process. A mold may be formed of actuating member 430 and pivot plate 422. The mold is formed by a shot sequence including a first shot in which actuating member 430 is formed and a second shot in which pivot plate 422 is formed. In some cases, actuating member 430 and pivot plate 422 could be molded using materials that are substantially different and that do not bond to one another. This allows actuating member 430 to spin in place with respect to pivot plate 422. In other cases, actuating member 430 and pivot plate 422 can be made of materials that bond chemically to one another during the molding process so that any relative movement between actuating member 430 and pivot plate 422 is prevented.

In some cases, cleat sub-assembly 440 may also formed using a three shot molding process. A mold may be formed of tip portion 460, base portion 442 and extending portion 450. In a first shot of the molding sequence, tip portion 460 may be formed around fastening portion 462. In a second shot of the molding sequence, base portion 442 could be molded. In a third shot of the molding sequence, extending portion 450 could be molded in order to connect base portion 442 and tip portion 460. In some cases, extending portion 450 may comprise a material that bonds to both tip portion 460 and base portion 442. In one embodiment, extending portion 450 may be made of thermoplastic polyurethane (TPU).

In order to join housing 410 with sole structure 110, any method of assembly could be used. In some cases, housing 410 may be friction fit into gap 461 of sole structure 110. In other cases, housing 410 could be bonded to sole structure 110 using some kind of adhesive. Additionally, actuating assembly 420 and/or cleat sub-assembly 440 could be secured within housing 410 using any kind of method including, but not limited to: friction fits, bonding, gluing, cementing, molding, and/or mechanical connectors. Moreover, the methods used for assembling different components of cleat assembly 140 could be selected so that some components are removable/interchangeable while other components may be permanently fixed in place. For example, in some cases, actuating assembly 420 could be fit within housing 410 so that actuating assembly 420 could be removed and replaced to improve the lifetime of cleat assembly 140.

In different embodiments, the materials used for different components could vary. For example, in some cases, first portion 404 of covering member 402 could be made of a substantially soft plastic material such as TPU. In other cases, however, first portion 404 could be made of any other material. In some cases, second portion 406 could be made of a material that is more rigid than first portion 404 in order to facilitate the transfer of forces between covering member 402 and actuating assembly 420.

Sole structure 110 could be made of any material or combination of materials. In some cases, sole structure 110 comprises a substantially rigid material. As one example, sole structure 110 could comprise a carbon-fiber chassis that is used as a durable lower layer for an article of footwear. In other cases, however, sole structure 110 could be made of any other material that provides the desired material characteristics, such as shock absorption.

Figure 7:
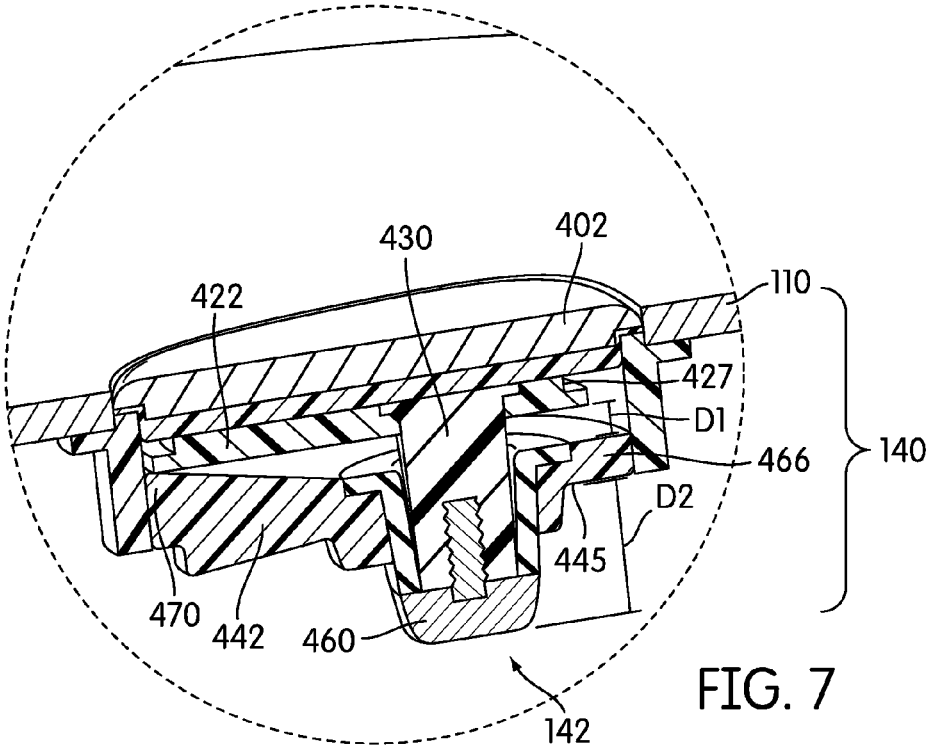
FIG. 7 is an isometric cut-away view of an embodiment of a cleat assembly.
Figure 8:
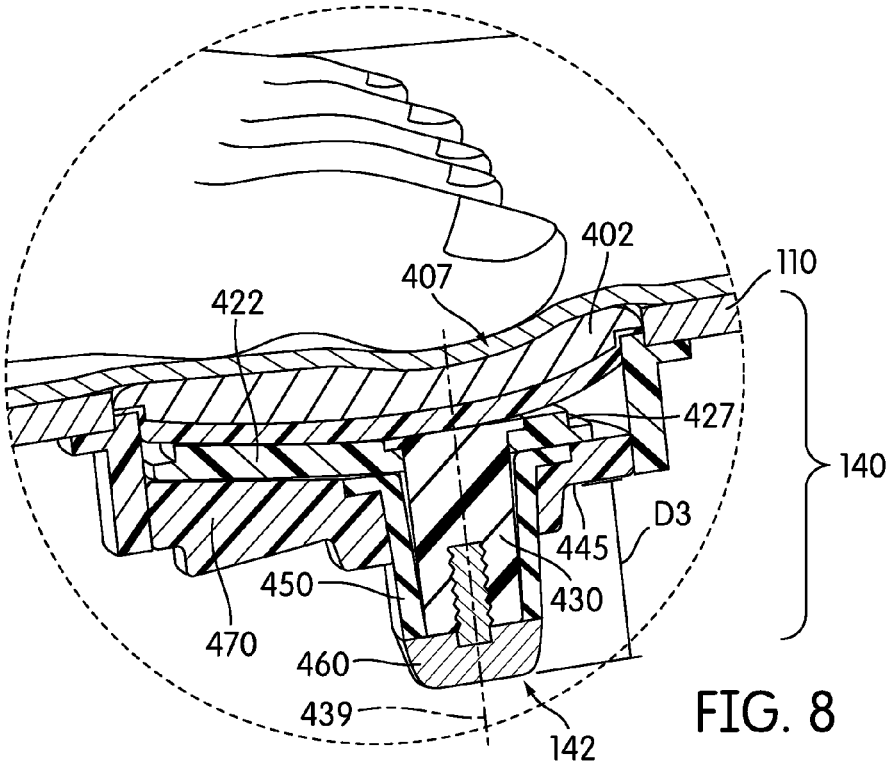
FIG. 8 is an isometric cut-away view of an embodiment of a cleat assembly in an extended position.

FIGS. 7 and 8 illustrate cleat assembly 140 in an unactuated, or default, position and an actuated position, respectively. The default position corresponds to the position of cleat assembly 140 whenever the amount of force applied to covering member 402 is less than some predetermined amount of force. The actuated position corresponds to the position of cleat assembly 140 whenever the amount of force applied to covering member 402 exceeds the predetermined amount of force. In the actuated position cleat member 142 is elongated and extends further away from sole structure 110.

The predetermined amount of force may be determined according to the construction of cleat assembly 140. For example, in some cases, the predetermined force may be chosen so that cleat assembly 140 is actuated under forces that would normally be encountered when a user cuts or makes another kind of athletic maneuver on a ground surface. In particular, the predetermined force may be chosen to be higher than the normal force applied by a user to covering member 402 due to the weight of the user. This helps prevent cleat member 142 from extending when a user is standing still on a ground surface. In some cases, the predetermined force is a threshold force above which the cleat may be extended between a default position and a fully extended position. It will be understood that in some cases, forces above the predetermined force may result in partial extension of the cleat member until the force is large enough to cause maximal extension of the cleat member.

In the default position shown in FIG. 7, first end portion 427 of pivot plate 422 is raised above first end 466 of base portion 442 by a distance D1. Moreover, cleat member 142 is extended from lower surface 445 of base portion 442 by distance D2. Referring now to FIG. 8, a foot provides a downward force at first region 407 of covering member 402. First region 407 may be approximately aligned with central axis 439 of actuating member 430. As first region 407 is depressed, the force is transferred from covering member 402 to actuating assembly 420. At this point, since the force is applied directly over actuating member 430, actuating member 430 is pressed downwards. Pivot plate 422 pivots about ramp portion 470 so that first end portion 427 of pivot plate 422 is lowered. In some cases, pivot plate 422 may deform and become approximately parallel with ramp portion 470. In other cases, pivot plate 422 may be lowered but may remain spaced apart from ramp portion 470.

As actuating member 430 is pressed into cleat member 142, extending portion 450 is stretched, thereby extending cleat member 142. This allows cleat member 142 to extend further into a ground surface in order to provide enhanced traction during various athletic maneuvers such as cutting.

In the current embodiment, cleat member 142 is extended a distance D3 below lower surface 445 of base portion 442. In some cases, distance D3 may be greater than distance D2 by an amount in the range between 0 and 5 millimeters. In some cases, distance D3 may be greater than distance D2 by an amount greater than 5 millimeters. In some cases, distance D3 is greater than distance D2 by approximately 3 millimeters. In other words, cleat member 142 is configured to extend by an amount of up to approximately 3 millimeters under a force applied by a wearer's foot during use.

Figure 9:
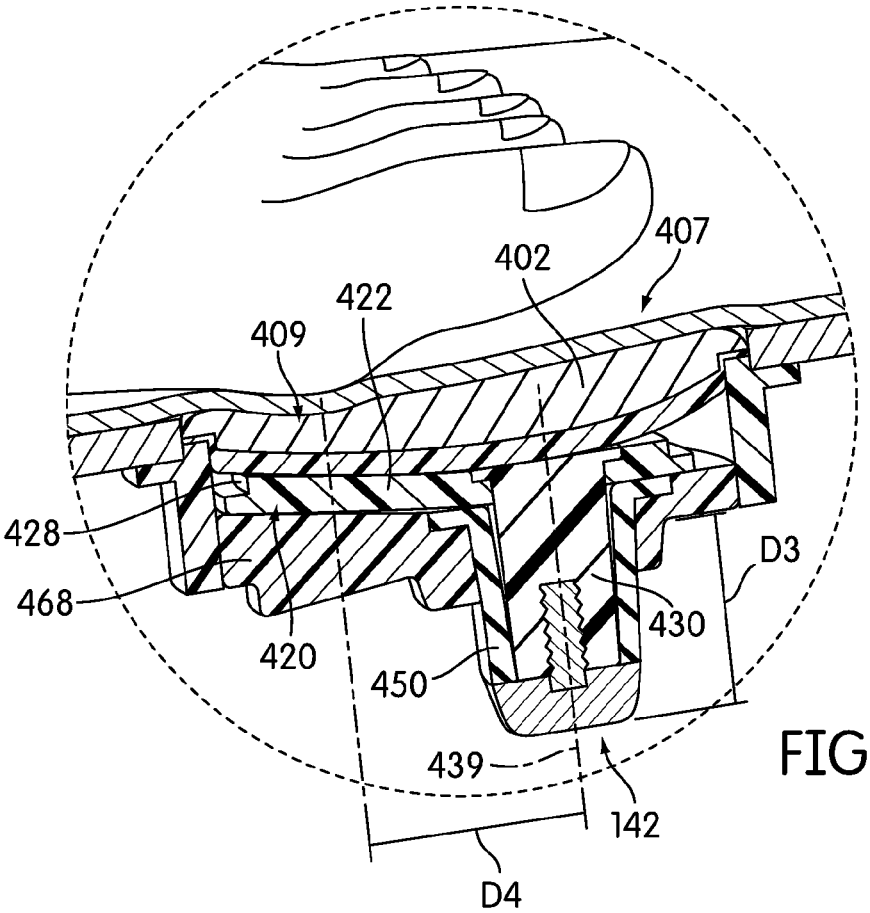
FIG. 9 is an isometric cut-away view of an embodiment of a cleat assembly in an extended position.

FIG. 9 illustrates an embodiment of the actuation of cleat assembly 140 under a downward force applied by a foot at second region 409 of covering member 402. In contrast to the configuration shown in FIG. 8, where the force is applied by the toe of the foot, in this configuration the force is applied by the ball of the foot. This results in covering member 402 applying a downward force to actuating assembly 420 at a location closer to second end portion 428 of pivot plate 422. In particular, the downward force is applied away from central axis 439 of cleat member 142. In this case, the force is applied at a location that is separated from central axis 439 by a distance D4 in the longitudinal direction of cleat assembly 140.

In this situation, the pivoting configuration of actuating assembly 420 allows pivot plate 422 to tilt downwardly. Moreover, as pivot plate 422 is tilted down, actuating member 430 applies a force to cleat member 142 that elongates extending portion 450. This results in the extension of cleat member 142 so that cleat member 142 is extended a distance D3 below lower surface 445 of base portion 442. In other words, although the force applied by the foot is not centered directly over actuating member 430, the pivoting arrangement of actuating assembly 430 provides a means for channeling the off-axis force to actuating member 430 in a manner that allows cleat member 142 to extend to a substantially similar distance as when the force is applied directly over actuating member 430. This helps increase the likelihood that cleat member 142 will be extended under a predetermined amount of force applied by a foot in order to ensure the proper amount of traction is supplied by cleat assembly 140.

Figure 10:
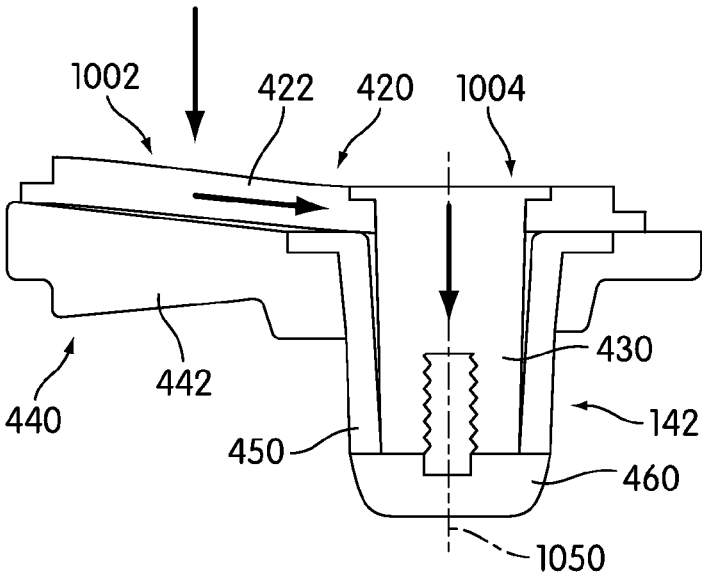
FIG. 10 is a schematic cross-sectional view of an embodiment of an actuating assembly and a cleat sub-assembly.

FIG. 10 is a schematic view of actuating assembly 420 and cleat sub-assembly 440 that is intended to show how an off-axis force is transferred to actuating member 430. In this case, a downward force is applied at first location 1002 of pivot plate 422. First location 1002 is located away from central axis 1050 of actuating member 430. However, the downward force tilts pivot plate 422 so that the force is transferred along pivot plate 422 from first location 1002 to second location 1004, which is a location of pivot plate 422 associated with actuating member 430. This force is then further transferred from actuating member 430 to cleat member 142 so that extending portion 450 is stretched and tip portion 460 can extend further into a ground surface. In other words, actuating assembly 420 acts to channel or funnel the force provided at any location along pivot plate 422 towards actuating member 430 and into cleat member 142.

The amount of extension undergone by a cleat member can vary. In some cases, the degree of extension may be substantially similar when the force is applied to different regions of a covering member. In other cases, the degree of extension could be substantially different when the force is applied to different regions of a covering member. Moreover, in some cases, the amount of extension could vary between 0 and 10 millimeters. In other cases, the amount of extension could vary between 1 and 3 millimeters. In still other cases, the amount of extension could be greater than 10 millimeters.

In some embodiments, pivot plate 422 may be configured to bend or otherwise deform under an applied force. In other embodiments, however, pivot plate 422 could remain substantially straight and may tilt or pivot without substantially deforming. The amount of bending or deformation of pivot plate 422 can depend on the type of materials used to form pivot plate 422 and may also depend on the geometry of pivot plate 422.

In some embodiments, cleat assembly 140 can include provisions to prevent unwanted extension of a cleat member. For example, in some cases, cleat assembly 140 can be configured so that cleat member 142 may not extend unless base portion 442 or sole structure 110 are in contact with a ground surface. This could be achieved by tuning cleat assembly 140 so that the predetermined force required to extend cleat member 142 is only achieved when base portion 442 is already contacting the ground.

Figure 11:
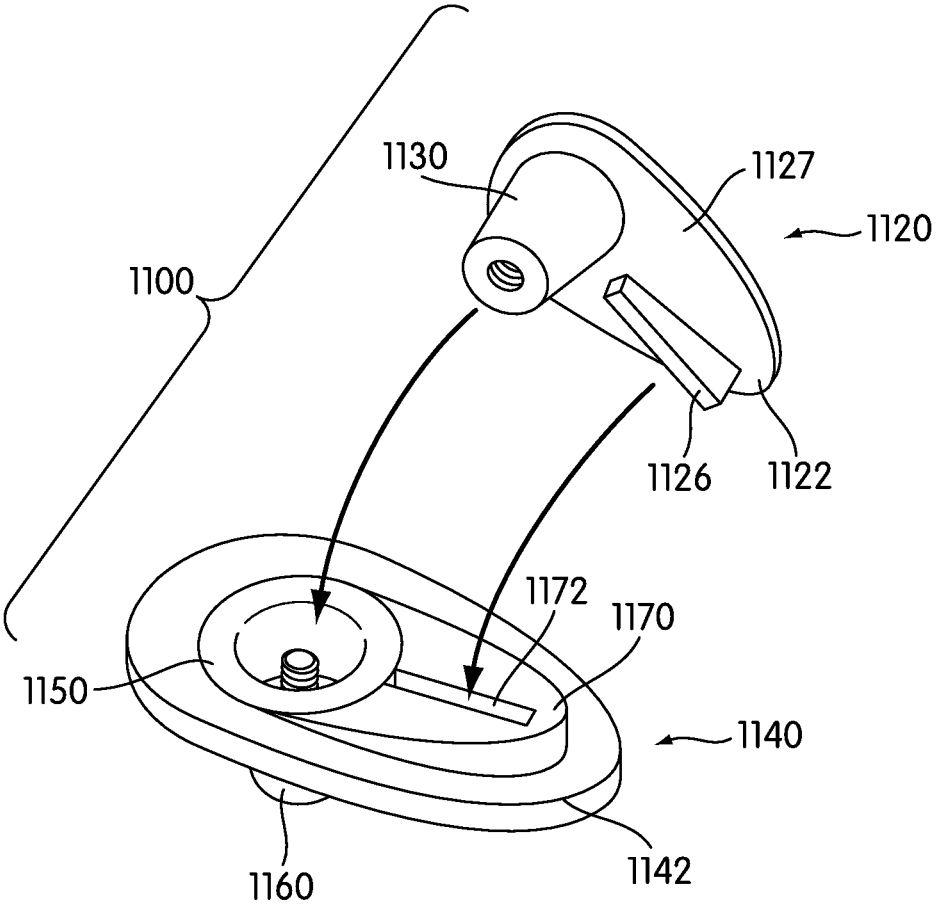
FIG. 11 is an isometric view of an alternative embodiment of a cleat assembly.

A cleat assembly can include provisions to facilitate stability and maintain consistent actuation. FIG. 11 illustrates an isometric view of an embodiment of a cleat assembly 1100. For purposes of clarity, actuating assembly 1120 and cleat sub-assembly 1140 are the only components of cleat assembly 1100 that are shown, however other embodiments could include additional components such as a housing and covering member.

Actuating assembly 1120 may include similar features to actuating assembly 420 of the previous embodiments. For example, actuating assembly 1120 can include pivot plate 1122 and actuating member 1130. Likewise, cleat sub-assembly 1140 can include similar features to cleat sub-assembly 440 of the previous embodiments. For example, cleat sub-assembly 1140 can include base portion 1142, extending portion 1150 and tip portion 1160. Base portion 1142 can further include ramp portion 1170.

In the current embodiment, actuating assembly 1120 and cleat sub-assembly 1140 are provided with means for maintaining alignment. In this case, pivot plate 1122 includes rib 1126 on a lower surface 1127 of pivot plate 1122 that is configured to confront base portion 1142. Additionally, base portion 1142 includes slot 1172 that is disposed in ramp portion 1170 and configured to receive rib 1126. In some cases, rib 1126 may be tapered so that pivot plate 1122 can still pivot or rock with respect to base portion 1142. This configuration can help maintain proper alignment between base portion 1142 and pivot plate 1122. In particular, this configuration prevents rotation between actuating assembly 1120 and cleat sub-assembly 1140.

It will be understood, however, that some embodiments may not include a rib and slot arrangement. In other cases, any other provisions known in the art for improving mechanical stability could be used to maintain the desired alignment between actuating assembly 1120 and cleat sub-assembly 1140.

FIGS. 12-19 illustrate various views of another embodiment of a sole structure including extendable cleats. The embodiment shown in FIGS. 12-19 may include some similar features to the embodiments discussed above. However, other features of the embodiments discussed above may be optional in the current embodiment. Moreover, the current embodiment could also include features not included in the above embodiments. It will likewise be understood that other embodiments could incorporate features from two or more different embodiments discussed in this detailed description.

Figure 12:
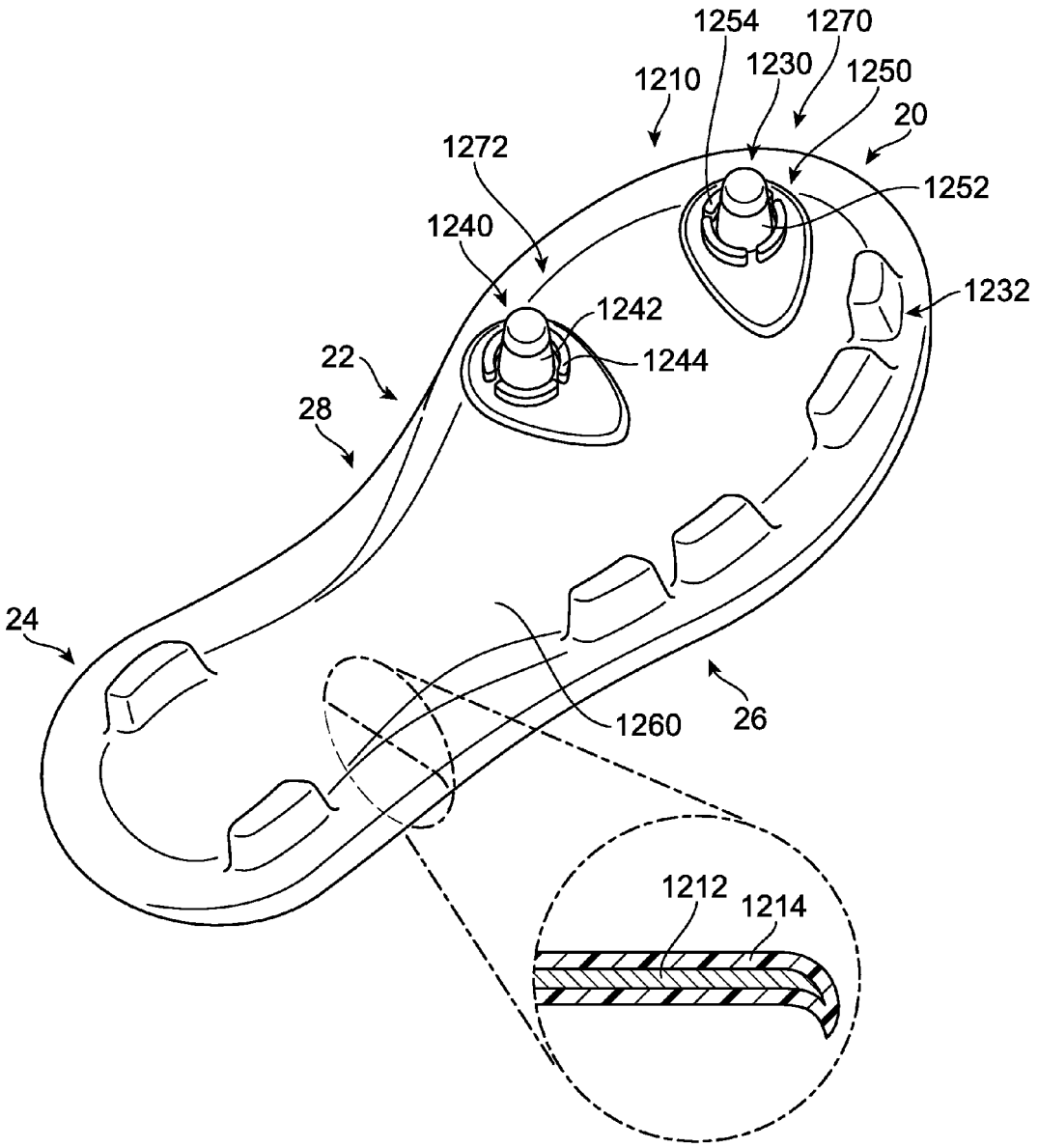
FIG. 12 is a bottom isometric view of an embodiment of a sole structure including two cleat assemblies with extendable cleats.

FIG. 12 illustrates an isometric bottom view of sole structure 1210 that may include one or more extendable cleats, as described below. For purposes of reference, components of sole structure 1210 may be divided into forefoot portion 20, midfoot portion 22 and heel portion 24. Forefoot portion 20 may be generally associated with the toes and joints connecting the metatarsals with the phalanges. Midfoot portion 22 may be generally associated with the arch of a foot. Likewise, heel portion 24 may be generally associated with the heel of a foot, including the calcaneus bone. In addition, sole structure 1210 may include lateral side 26 and medial side 28. In particular, lateral side 26 and medial side 28 may be opposing sides of sole structure 1210. Furthermore, both lateral side 26 and medial side 28 may extend through forefoot portion 20, midfoot portion 22 and heel portion 24.

It will be understood that forefoot portion 20, midfoot portion 22 and heel portion 24 are only intended for purposes of description and are not intended to demarcate precise regions of sole structure 1210. Likewise, lateral side 26 and medial side 28 are intended to represent generally two sides of a sole structure, rather than precisely demarcating sole structure 1210 into two halves. In addition, forefoot portion 20, midfoot portion 22 and heel portion 24, as well as lateral side 26 and medial side 28, can also be applied to individual components of a sole structure, such as a sockliner, insole or any other component.

In some embodiments, sole structure 1210 may be joined with an upper. The upper could be configured with any design, shape, size and/or color. Moreover, the upper could include various provisions for securing sole structure 1210 to a foot. In other cases, however, sole structure 1210 may not be attached to an upper.

In some embodiments, sole structure 1210 may be configured to provide traction for an article of footwear. In addition to providing traction, sole structure 1210 may attenuate ground reaction forces when compressed between the foot and the ground during walking, running or other ambulatory activities. The configuration of sole structure 1210 may vary significantly in different embodiments to include a variety of conventional or non-conventional structures. In some cases, the configuration of sole structure 1210 can be configured according to one or more types of ground surfaces on which sole structure 1210 may be used. Examples of ground surfaces include, but are not limited to: natural turf, synthetic turf, dirt, as well as other surfaces.

In different embodiments, sole structure 1210 may include different components. For example, sole structure 1210 may include an outsole, a midsole, and/or an insole. In some cases, one or more of these components may be optional. In one embodiment, sole structure 1210 may comprise an outsole or lower layer for the sole of a shoe and could be incorporated with a separate midsole (not shown) and/or insole.

In some embodiments, sole structure 1210 could comprise a substantially rigid chassis. For example, in some cases, sole structure 1210 could comprise a carbon fiber plate that provides strength and durability. In addition, in some cases, sole structure 1210 could include one or more layers of material that surround a rigid chassis. For example, in some cases, sole structure 1210 could comprise rigid chassis 1212 and molded plastic layer 1214, as shown in an enlarged cross section in FIG. 12. In some cases, rigid chassis 1212 could comprise a carbon fiber composite material. In other cases, rigid chassis 1212 could comprise any other substantially rigid material. In other cases, however, sole structure 1210 could comprise only a rigid layer, such as a carbon fiber layer. In still other cases, sole structure 1210 could comprise only a layer of molded plastic.

Sole structure 1210 can include cleat system 1230 that comprises one or more cleat members. In some cases, cleat system 1230 includes plurality of cleats 1232 disposed on lower surface 1260 of sole structure 1210. Plurality of cleats 1232 may comprise any type of cleats disposed in any portion of sole structure 1210. For example, in some cases, plurality of cleats 1232 includes four cleats disposed in forefoot portion 20 and two cleats disposed in heel portion 24 of sole structure 1210. In other cases, however, any other number and/or arrangement of cleats is possible. Moreover, in different embodiments the shape and/or size of cleats could vary.

In some cases, plurality of cleats 1232 comprises cleats with an approximately ridge-like shape. However, in other embodiments, any other shape for plurality of cleats 1232 is possible. In some other embodiments, different cleats of plurality of cleats 1232 could have substantially different shapes in order to provide different amounts of traction over different portions of sole structure 1210.

Cleat system 1230 can also include first cleat assembly 1240 and second cleat assembly 1250. First cleat assembly 1240 comprises cleat member 1242. In some cases, cleat member 1242 is an extendable cleat that is configured to penetrate further into a ground surface following actuation of some kind. In contrast to plurality of cleats 1232, which are fixed in place with respect to sole structure 1210, cleat member 1242 is capable of extending outwardly from sole structure 1210 in order to provide enhanced traction and control for a user. The operation of cleat assembly 1240, including the extension of cleat member 1242, is described in detail below.

In some cases, cleat assembly 1240 can also include projections 1244 that are part of cleat assembly 1240. Projections 1244 may be fixed in place with respect to sole structure 1210 in order to provide stability for the actuation of cleat member 1242. In some cases, projections 1244 can comprise cleat-like projections that enhance the traction provided by cleat assembly 1240.

In some embodiments, the number and arrangement of projections 1244 could vary. In some cases, projections 1244 may include a single projection. In other cases, however, projections 1244 may include two or more projections. In one embodiment, projections 1244 include three projections. In still other cases, projections 1244 can include more than three projections. Moreover, in some cases, projections 1244 may be evenly spaced around cleat member 1242 so as to encircle cleat member 1242. In other cases, however, projections 1244 could be arranged in any other manner on cleat assembly 1240.

Second cleat assembly 1250 may be configured in a similar manner to first cleat assembly 1240. In particular, second cleat assembly 1250 can include cleat member 1252 that is an extendable cleat configured to penetrate further into a ground surface following actuation of some kind. Moreover, second cleat assembly 1250 could include any number of projections 1254 that are arranged in any manner.

In different embodiments, the approximate location of a cleat assembly with an extendable cleat member could be varied. For example, in some cases, one or more cleat assemblies could be disposed in forefoot portion 20 of sole structure 1210. In other cases, one or more cleat assemblies could be disposed in midfoot portion 22 and/or heel portion 24 of sole structure 1210. In one embodiment, first cleat assembly 1240 and second cleat assembly 1250 may be disposed in forefoot portion 20 of sole structure 1210. In particular, first cleat assembly 1240 may be disposed in region 1272 of sole structure 1210 while second cleat assembly 1250 may be disposed in region 1270. In some cases, region 1270 may be associated with the toes, or phalanges, of the foot. In other cases, however, region 1270 could be any other region of sole structure 1210. In some cases, region 1272 may be associated with the ball of the foot and/or the metatarsal heads. In other cases, however, region 1272 could be any other region of sole structure 1210.

In some cases, a cleat assembly could be approximately located towards medial side 28 of sole structure 1210. In other cases, a cleat assembly could be located towards lateral side 26 of sole structure 1210. The location of a cleat assembly with an extendable cleat may be selected to correspond to a region where downward force is applied by a foot during various kinds of motion such as running and/or cutting. As an example, the current location of first cleat assembly 1240 and second cleat assembly 1250 along medial side 28 of forefoot portion 20 may allow the cleat assemblies to enhance traction as a user makes a medial cut.

Figure 13:
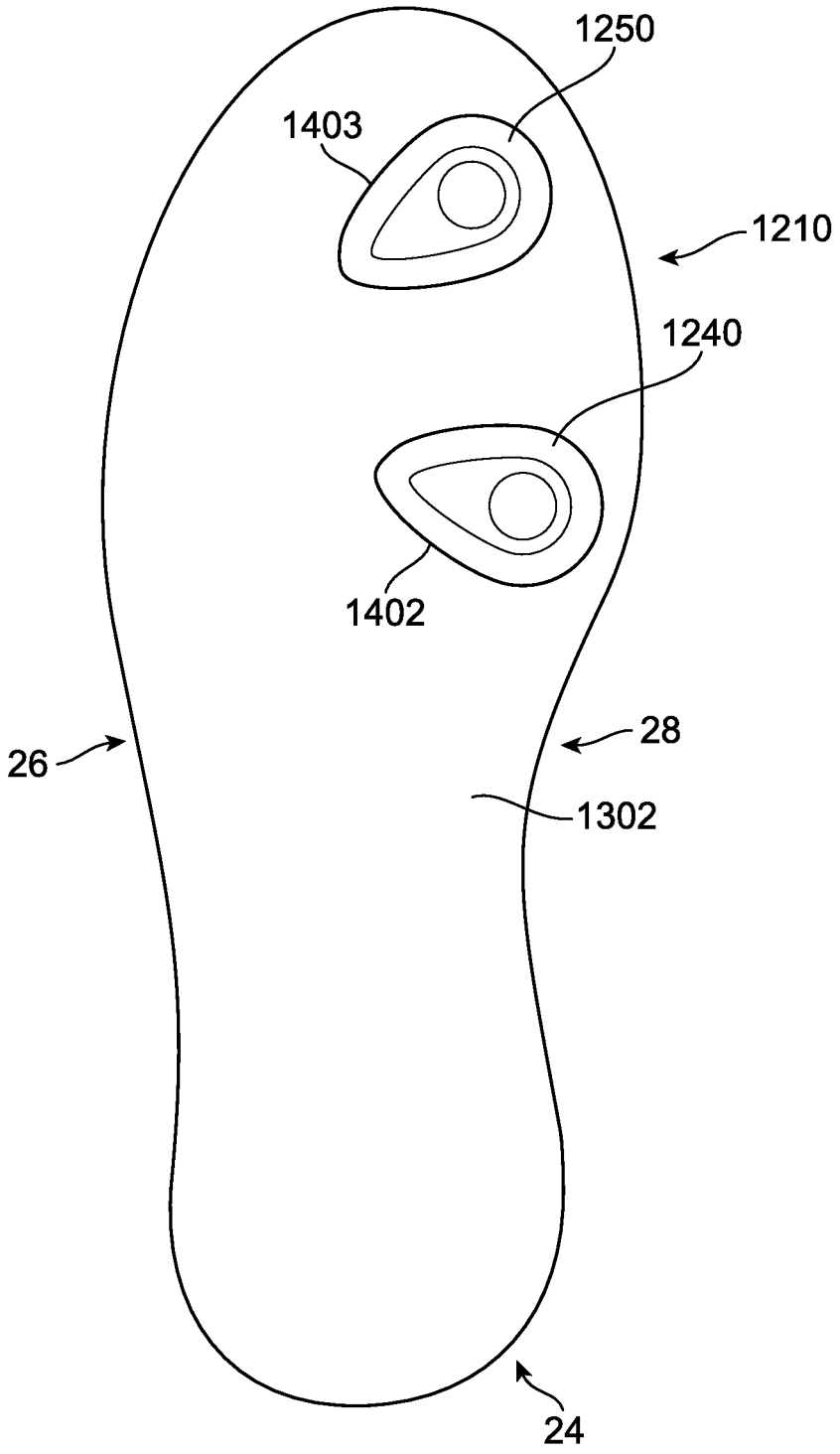
FIG. 13 is a top down view of an embodiment of a sole structure including two cleat assemblies.

FIG. 13 illustrates a top down schematic view of upper surface 1302 of sole structure 1210. Upper surface 1302 is a surface that is configured to face inwardly when sole structure 1210 is attached to an upper. In particular, upper surface 1302 is located proximally to lower surface 1260 (see FIG. 12) and therefore may be adjacent to a foot when an article incorporating sole structure 1210 is worn.

Referring to FIG. 13, sole structure 1210 can include first covering member 1402 and second covering member 1403 of first cleat assembly 1240 and second cleat assembly 1250, respectively. In some cases, each covering member is visible on upper surface 1302. In some cases, each covering member provides an actuating surface for transferring force to the respective cleat assembly.

In some cases, a covering member could be partially transparent, so that some portions of a cleat assembly can be seen beneath the covering member. In other cases, a covering member could be substantially opaque. In one embodiment, covering member 1402 and covering member 1403 are partially transparent. In particular, in some cases, portions of the actuating assemblies associated with cleat assembly 1240 and cleat assembly 1250 may be visible through covering member 1402 and covering member 1403, respectively.

Although two cleat assemblies are shown in the current embodiment, other embodiments could include additional cleat assemblies at various different locations on sole structure 1210. For example, in another embodiment, additional cleat assemblies could be disposed on lateral side 26 of forefoot portion 20. In still other cases, other cleat assemblies could be disposed in heel portion 24.

In some embodiments, first cleat assembly 1240 may be actuated as a user applies a downwards force to covering member 1402, in a manner described in further detail below. Likewise, second cleat assembly 1250 may be actuated as a user applies a downward force to covering member 1403.

Figure 14:
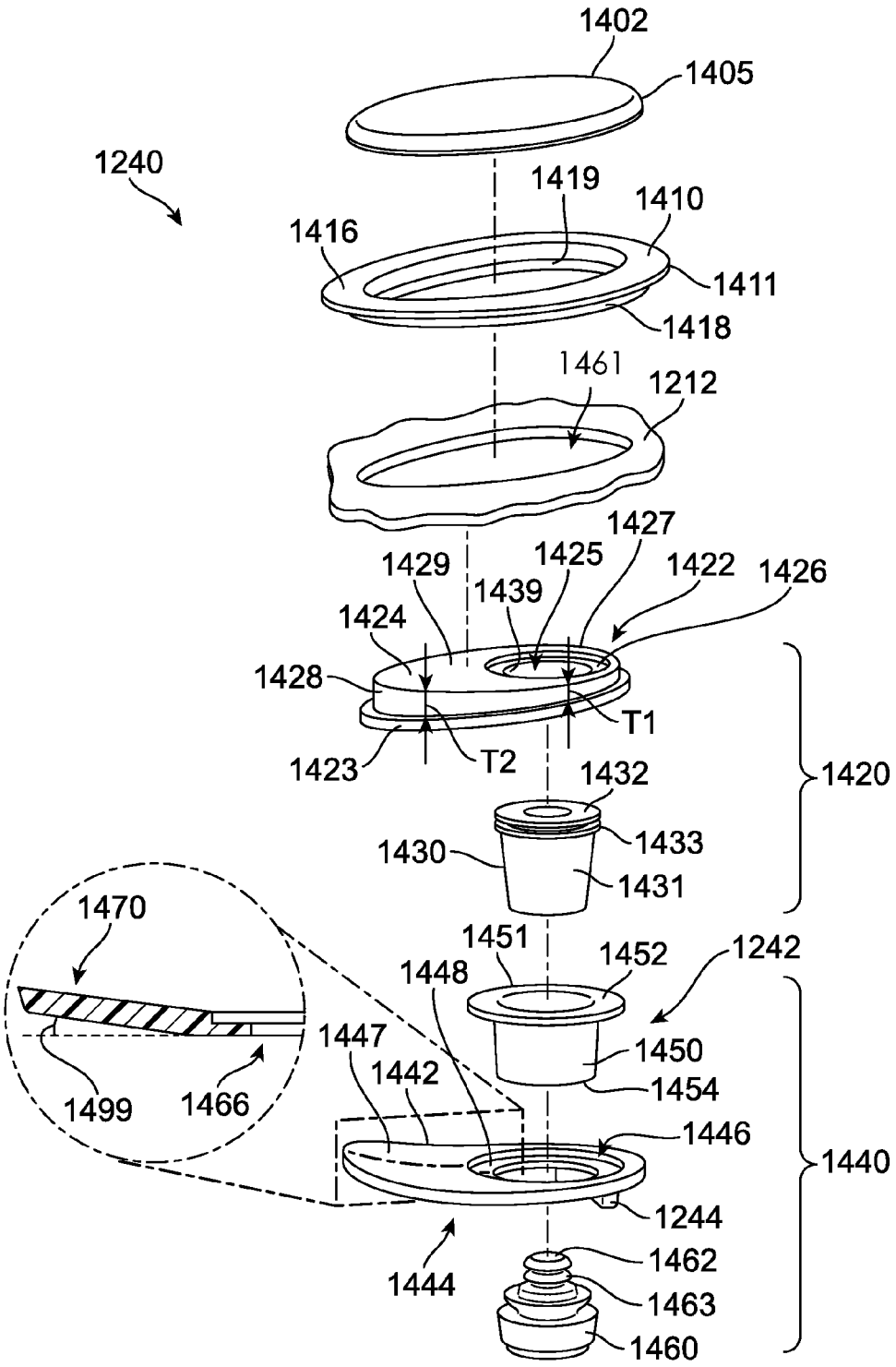
FIG. 14 is an exploded isometric view of an embodiment of a cleat assembly.

FIG. 14 illustrates an isometric exploded view of cleat assembly 1240. Cleat assembly 1240 may comprise covering member 1402, housing 1410, actuating assembly 1420 and cleat sub-assembly 1440.

Covering member 1402 may comprise a layer of material that is disposed over the top of housing 1410. Moreover, covering member 1402 is intended to be disposed over all of the components of cleat assembly 1240. This arrangement helps to protect the components of cleat assembly 1240 from debris. This arrangement also provides an actuating surface that can transfer forces between a foot and actuating assembly 1420.

In some cases, covering member 1402 comprises a substantially flexible member. By using a flexible covering member, cleat assembly 1240 can be easily actuated as covering member 1402 deforms to engage actuating assembly 1420 under an applied force. In other cases, however, covering member 1402 could be substantially rigid.

Housing 1410 comprises a ring-like structure with upper rim 1416 and lower portion 1418. In some cases, lower portion 1418 may be configured to insert into gap 1461 in chassis 1212 of sole structure 1210. In other cases, however, lower portion 1418 may not insert into gap 1461, and may instead insert into a recess or gap in an over molding layer of sole structure 1210. In still other cases, lower portion 1418 could rest on an upper surface of sole structure 1210.

In some cases, housing 1410 may comprise a substantially rigid material. In other cases, housing 1410 could comprise a substantially flexible material. Moreover, in some cases, housing 1410 could be more rigid than covering member 1402. In still other cases, housing 1410 could be less rigid than covering member 1402. In other cases, housing 1410 could have a substantially similar rigidity as covering member 1402.

In some cases, lower portion 1418 may be sized to receive portions of actuating assembly 1420. In particular, lower potion 1418 may be configured to restrain the sides of one or more portions of actuating assembly 1420. Additionally, in some embodiments, lower portion 1418 can include recessed portion 1419. In some cases, recessed portion 1419 may be configured to receive portions of actuating assembly 1420. This arrangement can provide a stopping mechanism to help reduce actuation of cleat assembly 1240 in a proximal direction, as discussed in further detail below. However, other embodiments may not include a recessed portion.

In some cases, covering member 1402 and housing 1410 can be permanently attached together. In other cases, however, covering member 1402 and housing 1410 may not be permanently attached together. Moreover, in some cases, outer edge 1405 of covering member 1402 may be aligned with outer edge 1411 of housing 1410. In other cases, outer edge 1405 may not be aligned with outer edge 1411.

Actuating assembly 1420 can further include pivot plate 1422 and actuating member 1430. Pivot plate 1422 can include lower portion 1423 and upper portion 1424. In some cases, the cross-sectional area of upper portion 1424 may be slightly less than the cross-sectional area of lower portion 1423. In some cases, for example, lower portion 1423 can comprise a lipped or flanged portion that is configured to interact with recessed portion 1419 of housing 1410.

Pivot plate 1422 also includes first end portion 1427 and second end portion 1428. First end portion 1427 may include hole 1425. In some cases, hole 1425 is a substantially rounded hole that is configured to receive actuating member 1430. Moreover, in some cases, hole 1425 may be further associated with upper recessed portion 1426 and lower recessed portion 1437 (see FIG. 15).

Actuating member 1430 can include base portion 1431. In some cases, base portion 1431 may have an approximately frustum-conical shape. In other cases, however, base portion 1431 could have any other geometry. The geometry of base portion 1431 can be selected so that base portion 1435 may be inserted into cleat member 1242.

Additionally, actuating member 1430 can include lower flange 1433 and upper flange 1432. In some cases, upper flange 1432 and lower flange 1433 can engage upper recessed portion 1426 and lower recessed portion 1437 of pivot plate 1422. This allows actuating member 1430 to attach to pivot plate 1422 so that portion 1439 of pivot plate 1422 is secured between upper flange 1432 and lower flange 1433. Using this arrangement, actuating member 1430 may be substantially flush with upper surface 1429 of pivot plate 1422. Moreover, this arrangement may help prevent actuating member 1430 from being separated from pivot plate 1422 following assembly of actuating assembly 1420.

In some cases, actuating member 1430 can be permanently fixed in place with respect to pivot plate 1422 so that actuating member 1430 cannot rotate with respect to pivot plate 1422. In other cases, however, actuating member 1430 may not be fixed in place with respect to pivot plate 1422 and may be configured to freely rotate within hole 1425. This arrangement allows actuating member 1430 to be fastened to a component of cleat sub-assembly 1440, as discussed in detail below.

In order to facilitate the actuation of cleat assembly 1240, the thickness of pivot plate 1422 can be varied. For example, in some cases, the thickness of pivot plate 1422 can be substantially constant. In other cases, the thickness of pivot plate 1422 could vary along the length of pivot plate 1422. For example, in one embodiment, the thickness T1 of pivot plate 1422 at first end portion 1427 could be substantially different than the thickness T2 of pivot plate 1422 at second end portion 1428. In some cases, thickness T1 may be substantially less than thickness T2. In other cases, thickness T1 may be substantially greater than thickness T2. In still other cases, thickness T1 and thickness T2 could be approximately similar. In an embodiment where the thickness of pivot plate 1422 is greater at second end portion 1428, the top surface 1429 of pivot plate 1422 could be slightly slanted or angled rather than completely flat.

Cleat sub-assembly 1440 can include base portion 1442 as well as cleat member 1242. Cleat member 1242 includes extending portion 1450 (also referred to as an elastic member) and tip portion 1460. Extending portion 1450 can include first end 1452 and second end 1454. In some cases, tip portion 1460 is joined with second end 1454.

Cleat sub-assembly 1440 can include provisions for engaging with actuating member 1430. In some cases, tip portion 1460 includes fastening portion 1462 that is configured to engage actuating member 1430. In some cases, fastening portion 1462 could be a threaded portion. In one embodiment, for example, fastening portion 1462 comprises threads 1463 that may engage actuating member 1430. In some cases, fastening portion 1462 could be a separate fastener that is attached to tip portion 1460. In other cases, fastening portion 1462 could be integrally formed with tip portion 1460, such as during a molding process. In still other cases, tip portion 1460 may not fasten to actuating member 1430. In some cases, for example, tip portion 1460 could be permanently attached to actuating member 1430.

In some embodiments, extending portion 1450 may be a substantially flexible portion that can extend and/or stretch under an applied force. In some cases, tip portion 1460 may comprise a substantially rigid portion. In particular, in some cases, tip portion 1460 may be substantially more rigid than extending portion 1450. As extending portion 1450 stretches or extends, so that first end 1452 is displaced further from second end 1454, tip portion 1460 may also extend away from first end portion 1452. In other cases, tip portion 1460 could also be made of a substantially elastic material and may partially deform under an applied force.

Base portion 1442 includes projections 1244 on lower side 1444 that have already been discussed and shown in FIG. 12. Projections 1244 can help increase traction and provide additional balance while cleat member 1242 is engaged with a ground surface. Base portion 1442 may also include hole 1446 on first end portion 1466 that receives extending portion 1450. In some cases, hole 1446 is further associated with recessed portion 1448 that may receive flange 1451 of extending portion 1450.

Base portion 1442 can also include angled portion 1470. Angled portion 1470 may be angled or sloped with respect to first end portion 1466 of base portion 1442, which includes hole 1446. In contrast to the ramped geometry of base portion 1442 in the previous embodiments, where the thickness of base portion 1442 increased, angled portion 1470 has a substantially constant thickness. With this arrangement, angled portion 1470 presents a sloped upper surface 1447 for base portion 1442 in order to facilitate off axis actuation of cleat member 1242.

In some embodiments, the slope of angled portion 1470 can vary. In some cases, the slope may be substantially constant. In other cases, the slope may vary, so that angled portion 1470 is curved. In some cases, the geometry of angled portion 1470 (including the slope) could be selected to achieve a predetermined amount of actuation for actuating assembly 1420 under a predetermined force.

In some cases, the angle 1499 between angled portion 1470 and first end portion 1466 of base portion 1442 can be varied in order to modify the actuation properties of cleat assembly 1440. In some cases, the value of angle 1499 can vary in the range between 0 and 45 degrees. In other cases, the value of angle 1499 can vary in the range between 0 and 20 degrees. In still other cases, the value of angle 1499 can vary in the range between 0 and 5 degrees.

In different embodiments, the geometry of various components of cleat assembly 1440 could vary. In some cases, some components could be substantially rounded. In other cases, some components could be substantially oval-like in shape. Moreover, still other components could have any other shapes including, but not limited to: rounded, circular, oval, rectangular, triangular, polygonal, regular and/or irregular shapes. Components could have symmetric shapes or asymmetric shapes. In one embodiment, some components of cleat assembly 1240 could have an anti-symmetric shape. In some cases, the anti-symmetric shape may be a tear-drop like shape. For example, the cross-sectional shapes of covering member 1402, housing 1410, pivot plate 1422 and base portion 1442 can have substantially tear-drop like shapes. Furthermore, the cross-sectional area of each component is larger at the ends aligned with cleat member 1242. This tear drop like shape allows cleat assembly 1240 to have a larger cross-sectional area in the region directly over cleat member 1242. This may result in a tear-drop like shape for the actuating zone over which cleat assembly 1240 can be engaged by a foot, as seen in FIG. 13. This arrangement may help restrict, or otherwise control, the regions of sole structure 1210 where off axis actuation of cleat assembly 1240 can occur.

It will be understood that the configuration of cleat assembly 1250 (see FIG. 12) could be substantially similar to the configuration of cleat assembly 1240 in many respects. In some cases, second cleat assembly 1250 could include substantially identical components that facilitate extending cleat member 1252 under an applied force. In other cases, however, second cleat assembly 1250 could include some components of first cleat assembly 1240, but not others. Moreover, in some cases, second cleat assembly 1250 could include additional provisions not found in first cleat assembly 1240.

Figure 15:
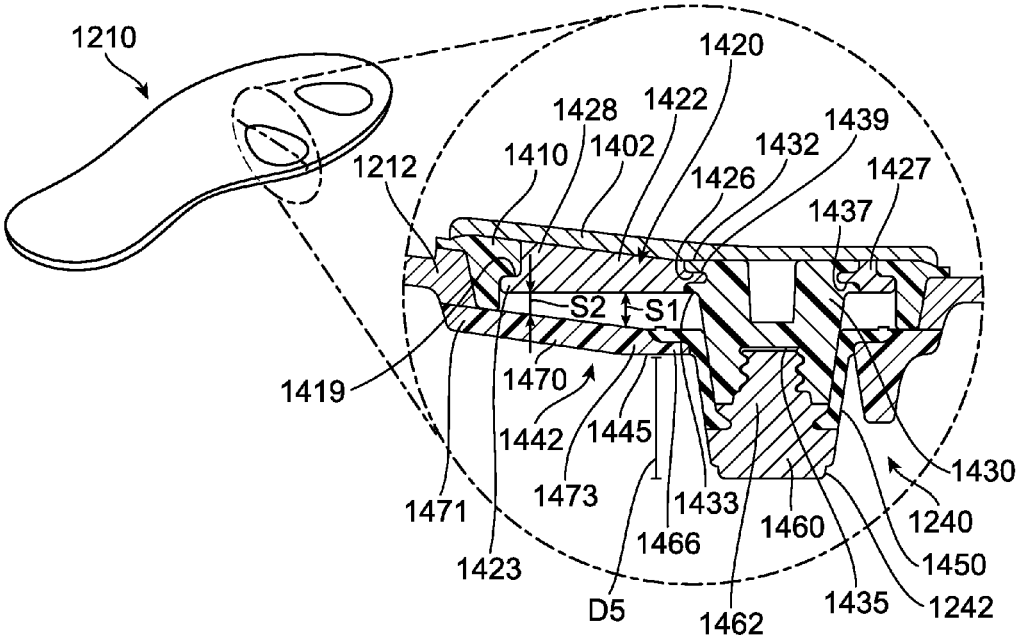
FIG. 15 is a side cross sectional view of an embodiment of a cleat assembly in a non-extended position.

FIG. 15 illustrates a cross sectional view of cleat assembly 1240. For purposes of clarity, layer 1214 of sole structure 1210 is not shown in FIG. 15 as well as in FIGS. 16 and 17, which are also cross-sectional views. Referring to FIG. 15, actuating member 1430 may be inserted through extending portion 1450. In one embodiment, actuating member 1430 may include threaded cavity 1435 that engages fastening portion 1462 in order to secure actuating member 1430 to tip portion 1460. This arrangement provides a connection between actuating member 1430 and tip portion 1460 so that cleat member 1242 and actuating member 1430 move together and helps keep actuating member 1430 disposed inside extending portion 1450.

Housing 1410 is inserted through chassis 1212 of sole structure 1210 so that actuating assembly 1420 is disposed partially within housing 1410. In addition, base portion 1442 is permanently attached to chassis 1212. With this arrangement, housing 1410, base portion 1442 and covering member 1402 enclose actuating assembly 1420 from the side, below and above, respectively. In particular, actuating assembly 1420 may be fully enclosed within these components.

In the default position shown in FIG. 15, in which the net downward force on covering member 1402 does not exceed a predetermined force, the elastic force of extending portion 1450 may keep pivot plate 1422 raised above base portion 1442. In particular, pivot plate 1422 and base portion 1442 are separated by some spacing, which provides some traveling space for pivot plate 1422 to move downwardly (or proximally) within cleat assembly 1240 during extension. In some cases, end portion 1471 of angled portion 1470 may be spaced apart from pivot plate 1422 by spacing S2 and end portion 1473 of pivot plate 1470 may be spaced apart from pivot plate 1422 by spacing S1. In some cases, spacing S2 may be substantially less than spacing S1, so that end portion 1473 is closer to pivot plate 1422 than end portion 1473. This allows end portion 1473 to come into contact with angle portion 1470 before end portion 1473 contacts angled portion 1470, thus allowing pivot plate to pivot about end portion 1471.

In order to help prevent cleat member 1242 from retracting too far into cleat assembly 1240, cleat assembly 1240 can be provided with one or more stopping mechanisms. In one embodiment, lower portion 1423 of pivot plate 1422 is configured to fit into recessed portion 1419 of housing 1410. At the point where lower portion 1423 engages recessed portion 1419, housing 1410 acts to restrain any further proximal movement of actuating assembly 1420. In other words, this configuration prevents actuating assembly 1420 from rising out of housing 1410 and applying a pressure back on the foot of the user. Although the current embodiment discloses one example of a stopping mechanism to restrict the retraction of a cleat member, it will be understood that in other embodiments any other kinds of stopping mechanisms and/or locking mechanisms could be used.

Referring back to FIG. 14, methods of making and assembling the various components of cleat assembly 1240 can vary in different embodiments. As an example, actuating assembly 1420 could be formed using a two shot molding process. A mold may be formed of actuating member 1430 and pivot plate 1422. The mold is formed by a shot sequence including a first shot in which actuating member 1430 is formed and a second shot in which pivot plate 1422 is formed. In some cases, actuating member 1430 and pivot plate 1422 could be molded using materials that are substantially different and that do not bond to one another. This allows actuating member 1430 to spin in place with respect to pivot plate 1422. In other cases, actuating member 1430 and pivot plate 1422 can be made of materials that bond chemically to one another during the molding process so that any relative movement between actuating member 1430 and pivot plate 1422 is prevented.

In some cases, cleat sub-assembly 1440 may also formed using a three shot molding process. A mold may be formed of tip portion 1460, base portion 1442 and extending portion 1450. In a first shot of the molding sequence, tip portion 1460 may be formed with an integrally formed fastening portion 1462. In a second shot of the molding sequence, base portion 1442 could be molded. In a third shot of the molding sequence, extending portion 1450 could be molded in order to connect base portion 1442 and tip portion 1460. In some cases, extending portion 1450 may comprise a material that bonds to both tip portion 1460 and base portion 1442. In one embodiment, extending portion 1450 may be made of thermoplastic polyurethane (TPU).

In order to join housing 1410 with sole structure 1210, any method of assembly could be used. In some cases, housing 1410 may be friction fit into gap 1461 of chassis 1212. In other cases, housing 1410 could be bonded to sole structure 1210 using some kind of adhesive. Additionally, actuating assembly 1420 could be secured within housing 1410 using any kind of method including, but not limited to: friction fits, bonding, gluing, cementing, molding, and/or mechanical connectors. Additionally, in some cases, base portion 1442 could be attached to chassis 1212 or any other portion of sole structure 1210 using any kind of attachment method including, but not limited to, those described above for securing housing 1410. Moreover, the methods used for assembling different components of cleat assembly 1240 could be selected so that some components are removable/interchangeable while other components may be permanently fixed in place. For example, in some cases, actuating assembly 1420 could be fit within housing 1410 so that actuating assembly 1420 may be removed and replaced to improve the lifetime of cleat assembly 1240.

In different embodiments, the materials used for different components could vary. For example, in some cases, covering member 1402 could be made of a substantially soft plastic material such as TPU. In other cases, however, covering member 1402 could be made of any other material. In addition, in some cases, extending portion 1450 could be made of a substantially elastic material. In some cases, extending portion 1450 could be made of a substantially similar material to covering member 1402. In other cases, extending portion 1450 could be made of a different material than covering member 1402. In one embodiment, covering member 1402 and extending portion 1450 could both be made of a plastic such as TPU.

Sole structure 1210 could be made of any material or combination of materials. In some cases, sole structure 1210 comprises a substantially rigid material. As one example, sole structure 1210 could comprise a carbon-fiber chassis that is used as a durable lower layer for an article of footwear. In other cases, however, sole structure 1210 could be made of any other material that provides the desired material characteristics, such as shock absorption. In one embodiment, sole structure 1210 comprises a carbon fiber chassis that is embedded in a plastic layer or matrix as previously described.

A cleat assembly can include provisions for improving actuation when a force is applied away from a cleat member (also referred to as off axis actuation). For example, in some cases, a cleat assembly can include a pivoting mechanism that helps ensure a cleat member extends when a user applies a force away from a central axis of the cleat member.

Referring to FIG. 15, angled portion 1470 may provide a fulcrum for pivot plate 1422. In particular, as a downward force is applied to actuating assembly 1420 from covering member 1402, second end portion 1428 of pivot plate 1422 may first come into contact with end portion 1471 of angled portion 1470, which is displaced proximally to end portion 1473 of angled portion 1470. This arrangement acts to tilt pivot plate 1422 about the contact point between end portion 1471 and pivot plate 1422.

Figure 16:
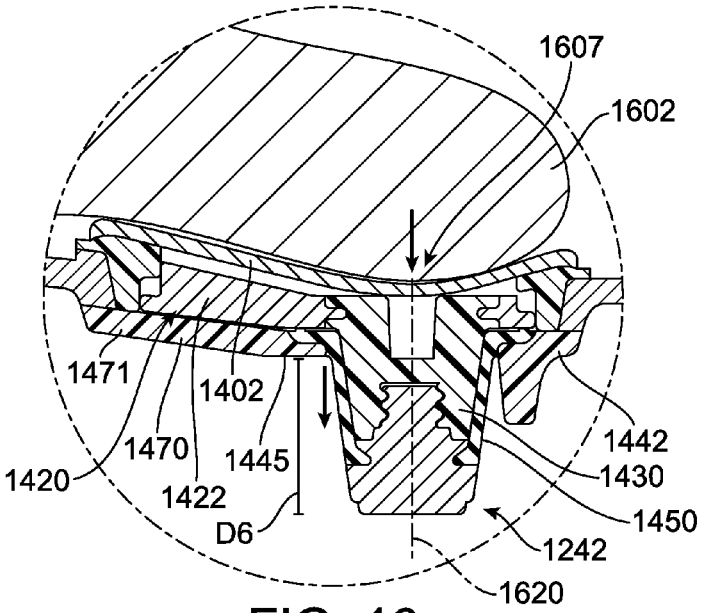
FIG. 16 is a side cross sectional view of an embodiment of a cleat assembly in an extended position.

FIGS. 15 and 16 illustrate cleat assembly 1240 in an unactuated, or default, position and an actuated position, respectively. The default position corresponds to the position of cleat assembly 1240 whenever the amount of force applied to covering member 1402 is less than some predetermined amount of force. The actuated position corresponds to the position of cleat assembly 1240 whenever the amount of force applied to covering member 1402 exceeds the predetermined amount of force. In the actuated position cleat member 1242 is elongated and extends further away from sole structure 1210.

The predetermined amount of force may be determined according to the construction of cleat assembly 1240. For example, in some cases, the predetermined force may be chosen so that cleat assembly 1240 is actuated under forces that would normally be encountered when a user cuts or makes another kind of athletic maneuver on a ground surface. In particular, the predetermined force may be chosen to be higher than the normal force applied by a user to covering member 1402 due to the weight of the user. This helps prevent cleat member 1242 from extending when a user is standing still on a ground surface. In some cases, the predetermined force is a threshold force above which the cleat may be extended between a default position and a fully extended position. It will be understood that in some cases, forces above the predetermined force may result in partial extension of the cleat member until the force is large enough to cause maximal extension of the cleat member.

In the default position shown in FIG. 15, first end portion 1427 of pivot plate 1422 is raised above base portion 1442. Moreover, cleat member 1242 is extended from lower surface 1445 of base portion 1442 by distance D5. Referring now to FIG. 16, a foot 1602 provides a downward force at first region 1607 of covering member 1402. First region 1607 may be approximately aligned with central axis 1620 of actuating member 1430. As first region 1607 is depressed, the force is transferred from covering member 1402 to actuating assembly 1420. At this point, since the force is applied directly over actuating member 1430, actuating member 1430 is pressed downwards. After traveling some distance, pivot plate 1422 contacts angled portion 1470 and pivots about end portion 1471 of angled portion 1470. In some cases, pivot plate 1422 may become approximately parallel with angled portion 1470. In other cases, pivot plate 1422 may be lowered but may remain spaced apart from angled portion 1470.

As actuating member 1430 is pressed into cleat member 1242, extending portion 1450 is stretched, thereby extending cleat member 1242. This allows cleat member 1242 to extend further into a ground surface in order to provide enhanced traction during various athletic maneuvers such as cutting.

In the current embodiment, cleat member 1242 is extended a distance D6 below lower surface 1445 of base portion 1442. In some cases, distance D6 may be greater than distance D5 by an amount in the range between 0 and 5 millimeters. In some cases, distance D6 may be greater than distance D5 by an amount greater than 5 millimeters. In some cases, distance D6 is greater than distance D5 by approximately 3 millimeters. In other words, cleat member 1242 is configured to extend by an amount of up to approximately 3 millimeters under a force applied by a the foot of a wearer. This additional 3 millimeters of extension may provide enhanced traction with a ground surface as a user cuts.

Figure 17:
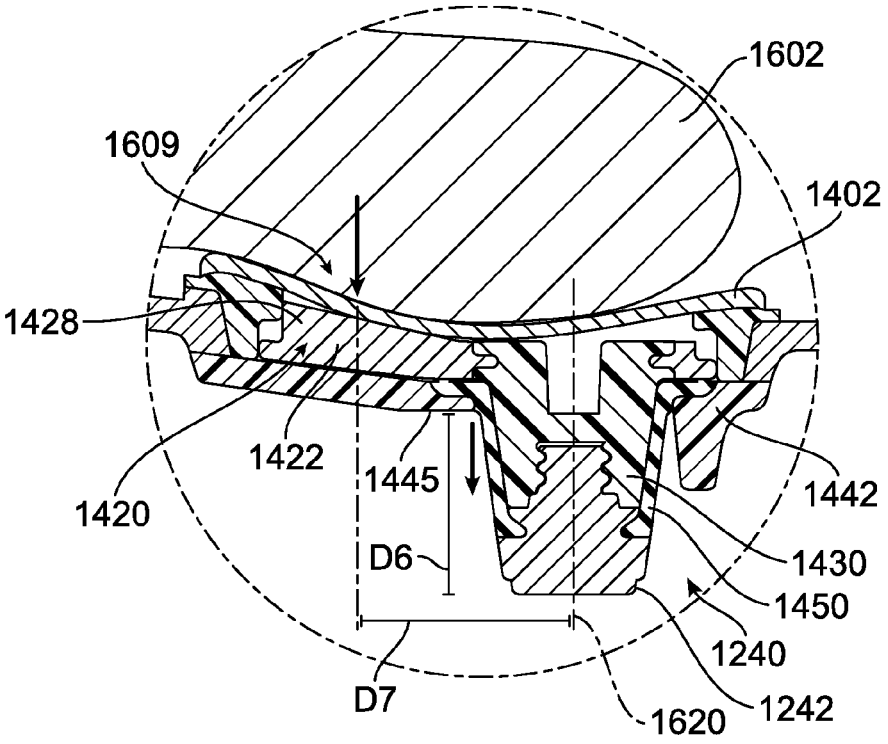
FIG. 17 is a side cross sectional view of an embodiment of a cleat assembly in an extended position.

FIG. 17 illustrates an embodiment of the actuation of cleat assembly 1240 under a downward force applied by a foot at second region 1609 of covering member 1402. In contrast to the configuration shown in FIG. 16, where the force is applied by the outer edge of foot 1602, in this configuration the force is applied by an inner portion of foot 1602. This results in covering member 1402 applying a downward force to actuating assembly 1420 at a location closer to second end portion 1428 of pivot plate 1422. In particular, the downward force is applied away from central axis 1620 of cleat member 1242. In this case, the force is applied at a location that is separated from central axis 1620 by a distance D7 in the longitudinal direction of cleat assembly 1240.

In this situation, the pivoting configuration of actuating assembly 1420 allows pivot plate 1422 to tilt downwardly. Moreover, as pivot plate 1422 is tilted down, actuating member 1430 applies a force to cleat member 1242 that elongates extending portion 1450. This results in the extension of cleat member 1242 so that cleat member 1242 is extended a distance D6 below lower surface 1445 of base portion 1442. In other words, although the force applied by the foot is not centered directly over actuating member 1430, the pivoting arrangement of actuating assembly 1420 provides a means for channeling the off-axis force to actuating member 1430 in a manner that allows cleat member 1242 to extend to a substantially similar distance as when the force is applied directly over actuating member 1430. This helps increase the likelihood that cleat member 1242 will be extended under a predetermined amount of force applied by a foot in order to ensure the proper amount of traction is supplied by cleat assembly 1240.

A sole structure can include provisions for enhancing the likelihood that a cleat member may extend into a ground surface. In some cases, the alignment of one or more cleat assemblies can be selected to improve the chance of cleat extension. In some cases, for example, each cleat assembly could be aligned in a radial manner with respect to a sole structure, which may increase the likelihood of actuation as the weight of a user shifts towards a lateral and/or forward edge of a sole structure during cutting or other athletic maneuvers.

Figure 18:
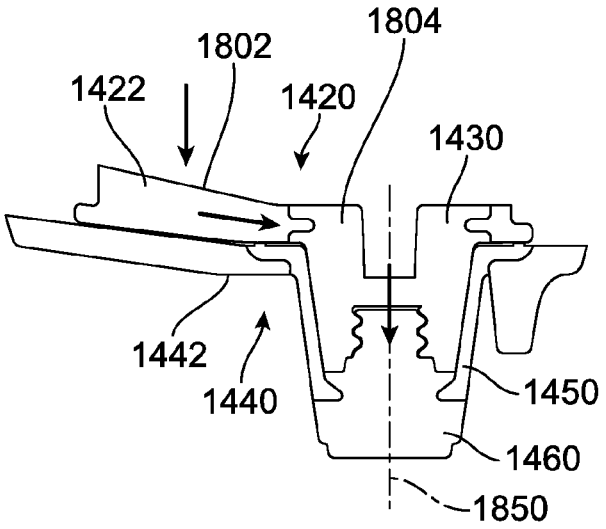
FIG. 18 is a schematic view of an embodiment of an actuating assembly directing an off axis force to a cleat member.

FIG. 18 is a schematic view of actuating assembly 1420 and cleat sub-assembly 1440 that is intended to show how an off-axis force is transferred to actuating member 1430. In this case, a downward force is applied at first location 1802 of pivot plate 1422. First location 1802 is located away from central axis 1850 of actuating member 1430. However, the downward force tilts pivot plate 1422 so that the force is transferred along pivot plate 1422 from first location 1802 to second location 1804, which is a location of pivot plate 1422 associated with actuating member 1430. This force is then further transferred from actuating member 1430 to cleat member 1242 so that extending portion 1450 is stretched and tip portion 1460 can extend further into a ground surface. In other words, actuating assembly 1420 acts to channel or funnel the force provided at any location along pivot plate 1422 towards actuating member 1430 and into cleat member 1242.

The amount of extension undergone by a cleat member can vary. In some cases, the degree of extension may be substantially similar when the force is applied to different regions of a covering member. In other cases, the degree of extension could be substantially different when the force is applied to different regions of a covering member. Moreover, in some cases, the amount of extension could vary between 0 and 10 millimeters. In other cases, the amount of extension could vary between 1 and 3 millimeters. In still other cases, the amount of extension could be greater than 10 millimeters.

In some embodiments, pivot plate 1422 may be configured to bend or otherwise deform under an applied force. In other embodiments, however, pivot plate 1422 could remain substantially straight and may tilt or pivot without substantially deforming. The amount of bending or deformation of pivot plate 1422 can depend on the type of materials used to form pivot plate 1422 and may also depend on the geometry of pivot plate 1422.

Figure 19:
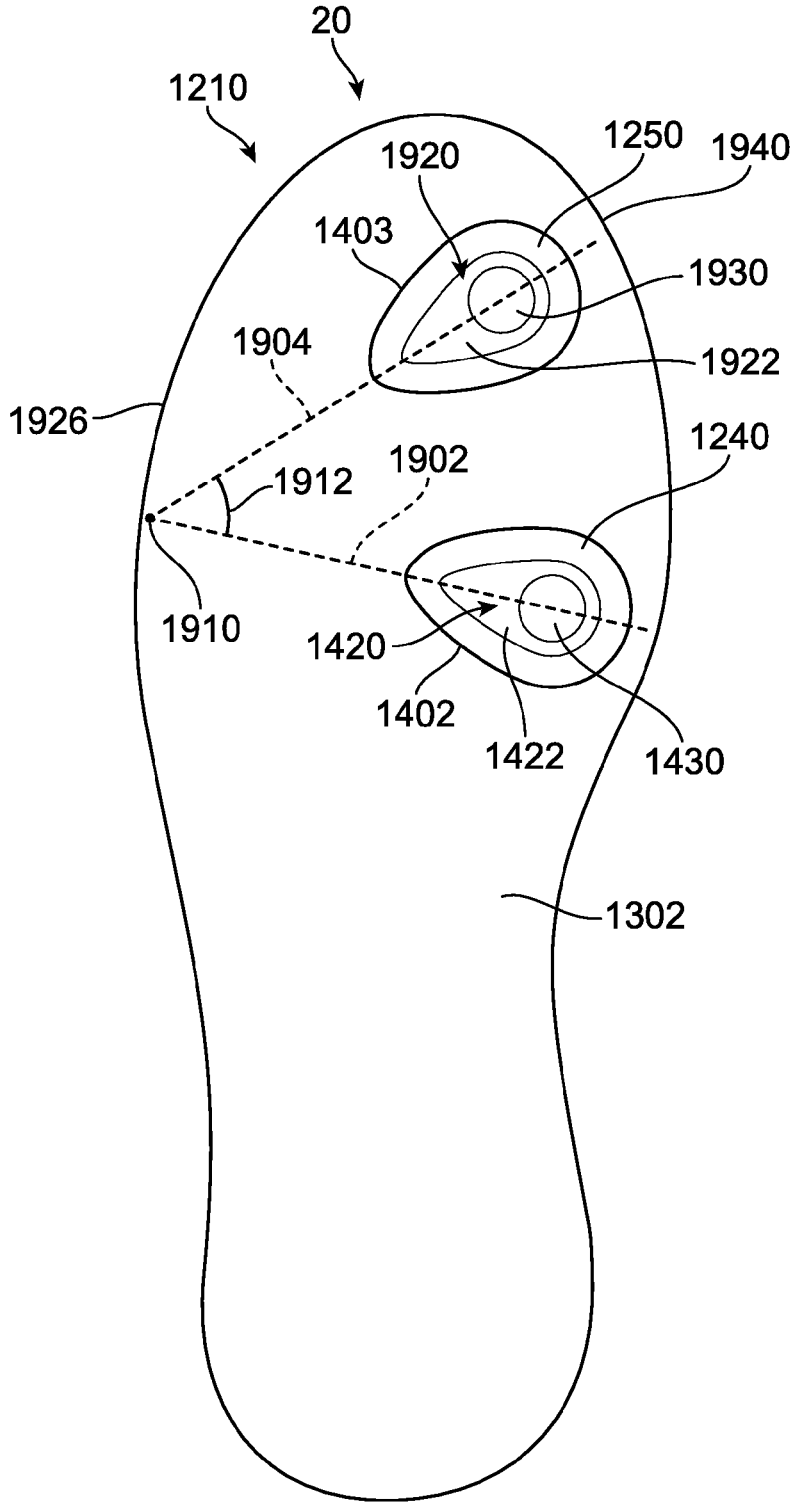
FIG. 19 is a top down view of an embodiment of a sole structure showing the relative orientation of two different cleat assemblies.

FIG. 19 illustrates a top down view of an embodiment of sole structure 1210 for purposes of showing the approximate arrangement of first cleat assembly 1240 and second cleat assembly 1250. In this case, covering member 1402 of first cleat assembly 1240 and covering member 1403 of second cleat assembly 1250 are visible on upper surface 1302 of sole structure 1210. Additionally, in embodiments where covering members are partially transparent, actuating assembly 1420, which includes actuating member 1430 and pivot plate 1422, may be visible through covering member 1402. Second cleat assembly 1250 can also include an actuating assembly 1920, which may be similar to actuating assembly 1420. In particular, actuating assembly 1920 can include pivot plate 1922 and actuating member 1930 that are visible through covering member 1403 in the current embodiment. Moreover, actuating assembly 1920 may be configured to transfer forces from covering member 1403 to cleat member 1252 (see FIG. 12) in a similar manner to the way that actuating assembly 1420 transfers forces from covering member 1402 to cleat member 1242.

Each cleat assembly can be associated with an axis that extends along a length of the cleat assembly and divides the cleat assembly into two approximately symmetric portions. For example, first cleat assembly 1240 may be associated with axis 1902 that extends along the longitudinal direction of first cleat assembly 1240 such that first cleat assembly 1240 is approximately symmetric about axis 1902 with respect to a lateral direction of first cleat assembly 1240. Likewise, second cleat assembly 1250 may be associated with axis 1904 that extends along the longitudinal direction of second cleat assembly 1250 such that second cleat assembly 1250 is approximately symmetric about axis 1904 with respect to a lateral direction of second cleat assembly 1250.

In some embodiments, axis 1902 and axis 1904 could be approximately aligned. For example, axis 1902 and axis 1904 could be approximately parallel. Such a configuration would comprise cleat assemblies that "point" in the same direction. In other embodiments, however, axis 1902 and axis 1904 may not be aligned. Instead, axis 1902 and axis 1904 could be disposed at an angle to one another. The angle between axis 1902 and axis 1904 could be measured with respect to the point of intersection between axis 1902 and axis 1904.

In one embodiment, axis 1902 and axis 1904 intersect at intersection point 1910. In different embodiments, the location of intersection point 1910 could vary. In some cases, intersection point 1910 could be located on sole structure 1210. In other cases, intersection point 1910 could be located beyond sole structure 1210. In one embodiment, intersection point 1910 is disposed adjacent to lateral edge 1926 of forefoot portion 20.

Axis 1902 may be angled with respect to axis 1904. In some cases, axis 1902 may be disposed at an angle 1912 with respect to axis 1904. Generally, angle 1912 can have any value. In some cases, angle 1912 can have a value approximately in the range between 0 and 360 degrees. In other cases, angle 1912 can have a value approximately in the range between 0 and 180 degrees. In still other cases, angle 1912 can have a value approximately in the range between 0 and 90 degrees. In still other cases, angle 1912 can have a value approximately in the range between 10 and 80 degrees. In still other cases, angle 1912 can have a value approximately in the range between 30 and 60 degrees.

In some cases, the arrangement of first cleat assembly 1240 and second cleat assembly 1250 can have an approximately radial configuration. For example, in the current embodiment, first cleat assembly 1240 and second cleat assembly 1250 are aligned with axis 1902 and axis 1904 that extend approximately radially from intersection point 1910. In other embodiments, however, the arrangement of first cleat assembly 1240 and second cleat assembly 1250 may not be radial and could have any other configuration.

Using the above arrangement, first cleat assembly 1240 and second cleat assembly 1250 may be positioned and oriented to achieve maximum cleat extension during various athletic maneuvers. For example, first cleat assembly 1240 is aligned in an approximately lateral direction with respect to sole structure 1210. As the user makes a cutting motion and shifts weight to the medial side of sole structure 1210, first cleat assembly 1240 may be oriented so that the direction of the weight shift near the ball of the foot corresponds to the direction of pivoting of actuating assembly 1420. This helps ensure that the maximum amount of force is transferred to actuating assembly 1420 in order to extend cleat member 1242. In contrast, second cleat assembly 1250 is aligned in a direction that is angled with respect to the lateral direction and longitudinal direction of sole structure 1210. This is useful since a player may often lead off from lateral forward edge 1940 of sole structure 1210 during a first step, and therefore the orientation of actuating assembly 1920 is configured to maximize actuation as weight is transferred towards lateral forward edge 1940.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A sole structure for an article of footwear including a cleat assembly, comprising:

a cleat member including an extending portion, the extending portion having a first end fixed relative to the sole structure and a second end designed to move relative to the first end, wherein the extending portion is elastomeric;

an actuating assembly including a pivot plate and an actuating member;

the pivot plate including a first end portion and a second end portion;

the actuating member attached to the first end portion the actuating member disposed within the extending portion and designed to elongate the extending portion by moving the second end of the extending portion away from the first end of the extending portion when force from a foot of a wearer actuates the actuating member; and wherein the pivot plate is configured to pivot about the second end portion of the pivot plate to transfer the force from the foot of the wearer to the extending portion.

2. The sole structure according to claim 1, wherein the cleat assembly further includes a housing and a base portion.

3. The sole structure according to claim 2, wherein the extending portion is attached to the base portion.

4. The sole structure according to claim 1, wherein the cleat member further includes a tip portion that is attached to the second end of the extending portion.

5. The sole structure according to claim 4, wherein the tip portion includes a fastening portion and wherein the actuating member is fastened to the fastening portion.

6. The sole structure according to claim 5, wherein the fastening portion includes threads and wherein the actuating member includes a threaded cavity for receiving the threads.

7. A sole structure for an article of footwear including a cleat assembly, comprising:

a cleat sub-assembly comprising a base portion and a cleat member attached to the base portion;

the base portion including a fulcrum;

the cleat member including an extending portion, the extending portion having a first end attached to the base portion and a second end designed to move relative to the first end, wherein the extending portion is elastomeric;

an actuating assembly including a pivot plate and an actuating member attached to the pivot plate;

the actuating member being disposed within the extending portion and positioned to transfer force from a foot of the wearer to a second end of the extending portion to elongate the extending portion; and wherein the pivot plate pivots on the fulcrum.

8. The sole structure according to claim 7, wherein the base portion includes a first end portion and a second end portion and wherein the first end portion includes a hole for receiving the cleat member.

9. The sole structure according to claim 8, wherein the fulcrum extends from the hole to the second end portion of the base portion.

10. The sole structure according to claim 7, wherein the pivot plate includes a first end portion and a second end portion and wherein the second end portion is disposed adjacent to the fulcrum.

11. The sole structure according to claim 10, wherein the first end portion of the pivot plate is spaced apart from the base portion by a first distance when a force less than a predetermined force is applied to the cleat assembly.

12. The sole structure according to claim 11, wherein the first end portion of the pivot plate is spaced apart from the base portion by a second distance that is less than the first distance when a force greater than the predetermined force is applied to the cleat assembly.

13. The sole structure according to claim 11, wherein the pivot plate is configured to transfer any downward force to the actuating member.

14. The sole structure according to claim 7, wherein the fulcrum comprises a ramp extending from the base portion.

15. A sole structure for an article of footwear including a cleat assembly, comprising:

an actuating assembly including a pivot plate and an actuating member, the pivot plate having a first end portion and a second end portion and wherein the actuating member is disposed adjacent to the first end portion;

a covering member including a first region and a second region, the first region disposed adjacent to the first end portion of the pivot plate and the second region disposed adjacent to the second end portion of the pivot plate;

a cleat sub-assembly including a base portion and a cleat member;

the base portion including a hole for receiving the cleat member and a fulcrum that is configured to contact the second end portion of the pivot plate;

the cleat member including an elastomeric extending portion, the extending portion having a first end fixed relative to the base portion and a second end designed to move relative to the first end;

the cleat member configured to receive the actuating member and wherein the cleat member can be extended away from the sole structure by the actuating member elongating the extending portion;

wherein the cleat assembly is configured to transfer force from the first region of the covering member to the actuating member and wherein the cleat assembly is configured to transfer force from the second region of the covering member to the actuating member.

16. The sole structure according to claim 15, wherein the fulcrum includes a slot.

17. The sole structure according to claim 16, wherein the pivot plate includes a rib that engages the slot.

18. The sole structure according to claim 15, wherein the pivot plate is disposed at an angle to the fulcrum when a force less than a predetermined amount of force is applied to the covering member.

19. The sole structure according to claim 15, wherein the pivot plate is approximately parallel with the fulcrum when a force greater than a predetermined force is applied to the covering member.

20. The sole structure according to claim 15, wherein the cleat assembly is disposed in a forefoot portion of the sole structure.

21. The sole structure according to claim 15, wherein the cleat assembly has a tear-drop shape.

22. The sole structure according to claim 15, wherein the cleat assembly includes a housing for restraining the actuating assembly and wherein the housing includes a recessed portion that is configured to engage a portion of the pivot plate.

23. The sole structure according to claim 22, wherein the recessed portion prevents further retraction of the cleat member by engaging the portion of the pivot plate and stopping the pivot plate from moving further in a direction towards a foot of a user.

24. A sole structure for an article of footwear, including:

a first cleat assembly and a second cleat assembly;

the first cleat assembly including a first actuating assembly and a first cleat member, wherein the first actuating assembly is designed to elongate a first elastomeric extending portion by displacing a first end of the first elastomeric extending portion away from a second end of the first elastomeric extending portion when a first force from a foot of a wearer actuates the first actuating assembly;

the second cleat assembly including a second actuating assembly and a second cleat member, wherein the second actuating assembly is designed to elongate a second elastomeric extending portion by displacing a first end of the second elastomeric extending portion away from a second end of the second elastomeric extending portion when a second force from the foot of the wearer actuates the second actuating assembly;

a first axis that is associated with a first length of the first cleat assembly;

a second axis that is associated with a second length of the second cleat assembly; and wherein the first cleat assembly and the second cleat assembly are arranged on the sole structure so that the first axis is angled with respect to the second axis.

25. The sole structure according to claim 24, wherein the first axis and the second axis form an angle in the range between 0 and 180 degrees.

26. The sole structure according to claim 24, wherein the first axis and the second axis form an angle in the range between 10 and 80 degrees.

27. The sole structure according to claim 24, wherein the first axis and the second axis form an angle in the range between 30 and 60 degrees.

28. The sole structure according to claim 24, wherein the first cleat assembly and the second cleat assembly are disposed in a forefoot portion of the sole structure.

29. The sole structure according to claim 28, wherein the first cleat assembly and the second cleat assembly are disposed on a medial side of the sole structure.

30. The sole structure according to claim 29, wherein an intersection between the first axis and the second axis is disposed near a lateral side of the forefoot portion.

31. The sole structure according to claim 24, wherein the first cleat assembly and the second cleat assembly are arranged in an approximately radial pattern.

* * * * *